US010925801B2

(12) United States Patent
Aarestad et al.

(10) Patent No.: US 10,925,801 B2
(45) Date of Patent: Feb. 23, 2021

(54) PRESSURE CONTROL SYSTEM, DEVICE AND METHOD FOR OPENING AN AIRWAY

(71) Applicants: SOMMETRICS, INC., Vista, CA (US); TTP PLC., Melbourne (GB)

(72) Inventors: Jerome K. Aarestad, Escondido, CA (US); Stephen Maine, Los Angeles, CA (US); Thomas John Harrison, Melbourn (GB)

(73) Assignees: SOMMETRICS, INC., Vista, CA (US); TTP PLC., Melbourn (GB)

( * ) Notice: Subject to any disclaimer, the term of this patent is extended or adjusted under 35 U.S.C. 154(b) by 253 days.

(21) Appl. No.: 15/803,730

(22) Filed: Nov. 3, 2017

(65) Prior Publication Data

US 2018/0125743 A1 May 10, 2018

Related U.S. Application Data

(60) Provisional application No. 62/418,114, filed on Nov. 4, 2016.

(51) Int. Cl.
*A61H 9/00* (2006.01)

(52) U.S. Cl.
CPC ... *A61H 9/0057* (2013.01); *A61H 2201/0173* (2013.01); *A61H 2201/0188* (2013.01);
(Continued)

(58) Field of Classification Search
CPC .. A61H 9/0057; A61H 9/0078; A61H 9/0092; A61H 2201/1609; A61H 2201/1611; A61H 2201/5071; A61H 2201/5082; A61H 2201/5084; A61H 2205/04; A61H 2205/3331;
(Continued)

(56) References Cited

U.S. PATENT DOCUMENTS 5,343,878 A 9/1994 Scarberry et al.
5,390,679 A * 2/1995 Martin ..... A61B 5/029 600/481
(Continued)

FOREIGN PATENT DOCUMENTS

JP 2005040422 A * 2/2005

OTHER PUBLICATIONS

The International Search Report and Written Opinion issued in PCT/US2017/060054 dated Aug. 31, 2018 (12 pages total).

*Primary Examiner* — Rachel T Sippel
*Assistant Examiner* — Kelsey E Baller
(74) *Attorney, Agent, or Firm* — Acuity Law Group, PC; Michael A. Whittaker

(57) ABSTRACT

The present invention provides a device with a pressure control system and methods for controlling the application of negative pressure to an external surface of an individual for creating and/or maintaining patency of the upper airway passage. The device is configured to fit under the chin of a subject at an external location corresponding approximately with the subject's internal soft tissue associated with the neck's anterior triangle. The pressure control system contains control module elements that may include circuit board elements, digital output barometer elements, sensor elements, processing elements and memory elements to optimize device function and safety of the device through regulation of the flow rate of the air pump.

24 Claims, 12 Drawing Sheets

(52) U.S. Cl.
CPC ..... *A61H 2201/1604* (2013.01); *A61H 2201/1609* (2013.01); *A61H 2201/5035* (2013.01); *A61H 2201/5038* (2013.01); *A61H 2201/5071* (2013.01); *A61H 2201/5079* (2013.01); *A61H 2201/5082* (2013.01); *A61H 2201/5084* (2013.01)

(58) Field of Classification Search
CPC ..... A61H 2205/3358; A61M 16/0009; A61M 16/0057; A61M 16/022; A61M 16/024; A61M 1/00; A61F 5/56
USPC ..... 73/700–756, 384
See application file for complete search history.

(56) References Cited

U.S. PATENT DOCUMENTS 7,182,082 B2 2/2007 Hoffrichter
7,762,263 B2 7/2010 Aarestad et al.
7,776,014 B2 * 8/2010 Visconti ..... A61M 1/0058 604/131
9,649,045 B2 * 5/2017 Alnabulsi ..... A61H 9/0078
9,820,881 B2 11/2017 Aarestad et al.
10,092,477 B2 * 10/2018 Grashow ..... A61H 7/00
10,179,083 B2 * 1/2019 Baudenbacher ..... A61H 9/0078
2003/0055346 A1 3/2003 Rapoport et al.
2003/0167018 A1 * 9/2003 Wyckoff ..... A61F 5/56 600/538
2005/0115561 A1 6/2005 Stahmann et al.
2006/0266369 A1 * 11/2006 Atkinson ..... A61F 5/56 128/848
2007/0016093 A1 1/2007 Rapoport et al.
2008/0163875 A1 * 7/2008 Aarestad ..... A61F 5/56 128/848
2009/0253995 A1 * 10/2009 Lewis ..... A61B 5/087 600/538
2011/0066086 A1 * 3/2011 Aarestad ..... A61F 5/56 601/11
2014/0144450 A1 * 5/2014 Aarestad ..... A61F 5/56 128/845
2014/0276174 A1 * 9/2014 Hyde ..... A61B 5/4836 600/534
2014/0276283 A1 * 9/2014 Mansur, Jr. ..... A61H 9/0078 601/150
2016/0030690 A1 2/2016 Tatkov et al.
2016/0374886 A1 * 12/2016 Wyatt ..... A61N 1/36014 601/18
2017/0143577 A1 5/2017 Aarestad et al.
2019/0021900 A1 1/2019 Aarestad et al.
2019/0125572 A1 5/2019 Aarestad et al.
2019/0142644 A1 * 5/2019 Askem ..... A61M 1/0031

* cited by examiner

PRESSURE CONTROL SYSTEM, DEVICE AND METHOD FOR OPENING AN AIRWAY

CROSS-REFERENCE TO RELATED APPLICATIONS

The present application claims priority to U.S. Provisional Application No. 62/418,114, filed Nov. 4, 2016, which is hereby incorporated by reference including all tables, figures, and claims.

BACKGROUND OF THE INVENTION

The following discussion of the background of the invention is merely provided to aid the reader in understanding the invention and is not admitted to describe or constitute prior art to the present invention.

The external application of negative pressure to patients for palliative or therapeutic purpose is well established in the medical arts.

U.S. Pat. Nos. 5,343,878, 7,182,082, and 7,762,263 relate to devices which purport to utilize external application of negative pressure upon the external neck surface of patients. A therapeutic appliance is typically provided that has a surface which is configured to enclose an external area of the throat (the term "throat" as used herein referring to the anterior portion of the neck extending approximately from the chin to the top of the sternum and laterally to a point posterior to the external jugular vein) overlying a portion of the upper respiratory passage. In certain embodiments, these appliances can provide a chamber (e.g., a hollow space filled with air molecules) lying between the interior surface of the chamber and the throat. The therapy appliance is operably connected to an air pump which is configured to produce a partial vacuum in this chamber. Application of a therapeutic level of negative pressure in the chamber elicits movement of the upper airway and may alleviate conditions such as snoring, sleep apnea, and full or partial airway collapse for example.

BRIEF DESCRIPTION OF THE INVENTION

It is an object of the invention to provide a pressure control system, and methods for the manufacture and use thereof, for controlling, monitoring and maintenance of negative pressure levels within a therapy device adapted to form a conforming interface between the device and a patient's external tissue, such as a face, a neck, an area surrounding a site for targeted therapy, etc. The therapy devices described herein are particularly suited for forming a sealed chamber that is configured for the administration of negative pressure to a targeted therapy on the external tissue of an individual.

In various embodiments, the pressure control systems of the present invention comprise one or more sensors which produce signals indicative of pressure levels from both the interior and exterior of the chamber, thus providing data that enable absolute pressure measurements from the interior of the chamber regardless of altitude or other changes in barometric pressure. Pressure control systems utilized for these or similar purposes should preferably be responsive to such "long term" changes, but not respond too quickly to transient changes and or spikes in pressure due to, for example, momentary body movement.

In addition to applications in negative pressure therapy devices, pressure control systems of this type are particularly useful for measuring absolute differential pressure across any barrier, for example provide a measurement (gauge) for the absolute differential pressure in any type of sealed or partially sealed system for example pressurized tanks, scuba, propane etc. regardless altitude, temperature etc. The pressure control system may also contain additional sensors, i.e. various types of MEMS that aid in the collection of data that may further assist in monitoring of parameters, processing and or storage of data that aid in the maintenance of a desired pressure range for example, device/user orientation, seismic data (vibration from sound, impact, pulse, respiration, etc) as well as temperature sensors.

In a first aspect, the invention provides a pressure control system for controlling the application of negative pressure to an external surface of an individual. The pressure control systems comprise:

a chamber element configured to define a chamber overlying the external surface of the individual and to apply a force to this external surface of the individual when a therapeutic level of negative pressure is applied within the chamber element;

a control module comprising (i) a circuit board having a first surface exposed to the negative pressure within the chamber element and a second surface exposed to atmospheric pressure external to the chamber element, (ii) a first absolute output barometer positioned on the first surface and configured to produce a first time-dependent waveform indicative of an absolute pressure within the chamber element, (iii) a second absolute output barometer positioned on the second surface and configured to produce a second time-dependent waveform indicative of an absolute atmospheric pressure external to the chamber element, (iv) a first processing element operably connected to the first absolute output barometer and the second absolute output barometer and configured to receive the first and second time-dependent waveform and to calculate therefrom a time-dependent value for the negative pressure within the chamber element which is relative to the absolute atmospheric pressure external to the chamber element, and (v) a first, preferably non-volatile, memory which stores one or more stored parameters indicative of a predetermined therapeutic level, or range thereof, of negative pressure to be applied within the chamber element; and an air pump operably connected to the chamber to produce the therapeutic level of negative pressure within the chamber element, wherein the air pump is operably connected to the control module, and wherein the flow rate of the air pump is regulated by the control module to maintain the therapeutic level of negative pressure within the chamber element within the predetermined range based upon the time-dependent value for the negative pressure within the chamber element.

The term "pressure control system," as used herein refers to the elements of the therapy device that monitor, maintain, record, adjust and energize and de-energize an air pump in a negative pressure therapy device during use. The pressure control system typically comprises one or more, and preferably each, of the following elements: a control module, comprising one or more circuit boards, one or more absolute barometers, one or more processing elements, one or more (preferably non-volatile) memory elements, one or more minimum and maximum pressure ranges and one or more profiles for regulating the air flow rate of the air pump, operably connected to an air pump to produce a therapeutic level of negative pressure within the chamber element of a negative pressure therapy.

In certain embodiments the pressure control system may contain elements or parameters that define the operation of the air pump, for example stored parameters indicating predetermined ranges of negative pressure. By way of example, these parameters may include a "setpoint" value indicating a target negative pressure, ranges to which minimum and maximum values may be constrained, or simply one or more predetermined therapeutic ranges. These parameters define the "target pressure" and "therapeutic level of negative pressure" of the device and may vary as desired for the effective application of therapy.

The pressure control system of the therapy device is configured to provide an approximately constant target negative pressure within the chamber element when the therapy device is mated to the individual and a therapeutic level of negative pressure is applied within the chamber element. By "approximately constant" as used herein is meant that the negative pressure is maintained within a predetermined range during normal intended use (i.e., when there is no pressure change from leakage other than leakage which is designed to occur to provide airflow into the chamber), without responding to short-term transient spikes or drops (increases or decreases) in negative pressure from momentary movement, swallowing, sneezing etc. As described hereinafter, the pressure control system is also preferably configured to accommodate pressure changes from unintended leakage by rapidly increasing pump airflow when the characteristics of a pressure drop are indicative of a loss of seal integrity.

The pressure control system may further be configured to apply different types of therapy target pressure during use due to body movement, position of the device/user or the onset or alleviation of upper airway narrowing or obstruction. This approximately constant target negative pressure may have a predetermined range, a target pressure with upper and lower limits, i.e. target pressure range, that comprises a maximum value, a minimum value and a midpoint value wherein the maximum and minimum values are each within about 5 hPa, and more preferably within about 2 hPa of the midpoint value (+/−~5 hPa, and preferably ~2 hPa) wherein the midpoint value is between about 10 hPa and about 60 hPa, between about 20 hPa and about 50 hPa and between about 25 hPa and about 35 hPa. In preferred embodiments the midpoint value is about 30 hPa. The term "about" as used herein refers to +/−10% of a recited value.

In certain embodiments, the predetermined range may be permitted to vary, for example depending upon the type of therapy being delivered; depending upon body position or other biometric signals; or to accommodate for new user acclimation, where in a lower predetermined pressure range may be selected and subsequently increased over a period of time. These control techniques could also be applied to varying the applied therapy of other devices used to prevent airway narrowing and collapse such as continuous positive airway pressure (CPAP) devices.

The terms "external area" and "external surface" of an individual as used herein refers to a portion of the external skin surface of the individual. In various embodiments, the therapy device is configured to provide optimized fitting parameters, for example, seal, comfort and local device compliance throughout all points of contact. This is preferably achieved by minimizing the contact pressure differential from one point of contact on the skin of a patient to another through design features of the cushion element and design features of the sealed chamber element of a negative pressure therapy device.

In certain embodiments, the pressure control system of the therapy device contains elements for regulating the flow rate of the air pump in order to maintain the therapeutic level of negative pressure for example profiles stored in (non-volatile) memory elements to energize the air pump when the minimum value of the predetermined range is reached and de-energize the air pump when the maximum value of the predetermined range is reached, and in combination with structural elements of the therapy device the magnitude of forces applied to the skin surface of the individual can be varied from point to point around the continuous contact area. In this manner, the force applied to the external surface of the individual at any point along the circumferential dimension of the sealing element may be made to be "constant." In this context, the term "constant" as used herein, refers to maintaining the force within about 20%, and more preferably about 10%, of the average force along the entire circumferential dimension of the sealing element, where the force at each point along the circumferential dimension of the sealing element is measured at the location on the width dimension of the flange element at which sealing element contacts the user.

Any and all air pump types find use in the present invention, provided that a therapeutic level of negative pressure (vacuum) can be achieved by the air pump (wherein negative pressure and vacuum may be used interchangeably). In certain embodiments, the air pump may be connected to the apparatus via a hose or tube. Preferably, the air pump is wearable by the patient and is battery powered, and most preferably the air pump is configured integrally to the apparatus. In certain embodiments, the air pump may be a manual squeeze bulb, or may be electric and comprise a piezoelectric material configured to provide an oscillatory pumping motion. It is most preferred that the oscillatory pumping motion operates at a frequency greater than 500 Hz.

In certain embodiments, the pressure control system is designed to accommodate a chamber element that comprises one or more air vent elements (e.g., apertures, pathways, etc.) that provide an airflow from the ambient environment external to the chamber into the chamber when the therapy device is mated to the individual and a therapeutic level of negative pressure is applied. This is referred to herein as a "designed airflow". Such a designed airflow may be utilized, for example, to prevent a buildup of temperature and humidity within the interior of the chamber. By way of example, one or more apertures, optionally comprising a filter element, may be located distal to the intake of an air pump element to provide a flow of air through the chamber. In certain embodiments, a designed airflow is between about 10 cc/min and about 300 cc/min, and preferably between about 20 cc/min and about 150 cc/min, and still more preferably between about 30 cc/min and about 100 cc/min.

In certain embodiments the level of designed airflow can vary. In certain embodiments, the level of airflow may be regulated according to the therapeutic level of negative pressure; that is, a higher level of vacuum can be accompanied by a higher level of airflow due to the differential in pressure between the atmospheric side of the vent elements and the interior of the chamber. In certain embodiments the vacuum source may be used in a variable manner to maintain the therapeutic level of vacuum within a specified range rather than a single value, and the level of airflow can vary in concert with the level of vacuum. In certain embodiments the pressure control system can designate a target applied vacuum and can ramp up slowly from a low therapeutic level of negative pressure to a higher desired therapeutic level of negative pressure within a single use or over several use sessions that could span several days allowing a user a specified period of time to acclimate to the device. In additional embodiments the pressure control system can comprise the use of adaptive treatment parameters that can vary therapeutic levels of negative pressure based on changes in one or more monitored parameters such as heart rate, respiration rate, head/device position, sounds and or apneic events.

In related aspects, the present invention relates to methods of applying negative pressure therapy to an individual in need thereof, comprising mating a therapy device as described herein to the individual, and applying a therapeutic level of negative pressure within the chamber, thereby increasing patency of the airway of the individual. Such methods can be for treatment of sleep apnea; for treatment of snoring; for treatment of full or partial upper airway collapse; for treatment of full or partial upper airway obstruction; for negative pressure treatment of a wound caused by, for example an injury or a surgery; etc.

Figure 1A:
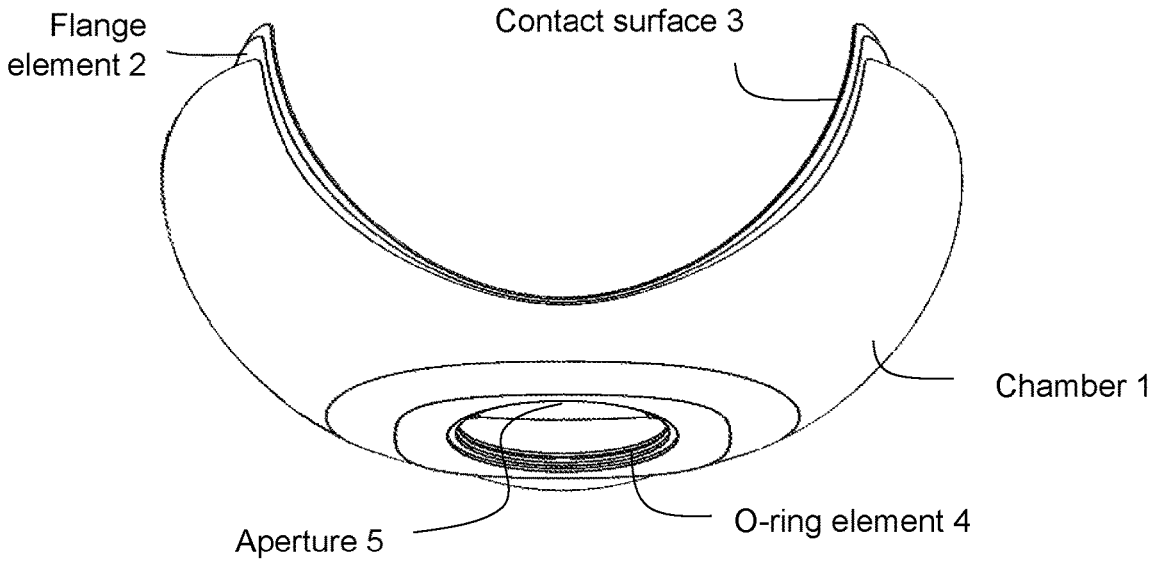
FIG. 1A is top view of an illustrative embodiment of an exemplary negative pressure therapy device including the chamber 1, flange element 2, flange/contact surface of the flange 3, O-ring element 4 and aperture 5 to receive the pressure control system.

200 shows a trace of a target pressure over time, 210 shows a trace of data received from accelerometers regarding magnitude of movement and position over time, 220 shows a trace indicating the derivate of the data of trace of 210 over time, 230 shows a trace of threshold movements over time and 240 shows a trace non-threshold movement over time. 245 shows a non-threshold movement 250 corresponding to a change in sustained position from supine to side corresponding to a change in target therapy pressure 255, 260 is an example of a threshold movement 265 corresponding to a change in position from side through supine to an opposite side triggering a reactionary target pressure 270, when threshold movement ceases 263, the control system returns to a target therapy pressure corresponding to a side position 267. 280 corresponds to a supine target pressure, 285 corresponds to a side target pressure and 290 corresponds to a reactionary target pressure.

Figure 11:
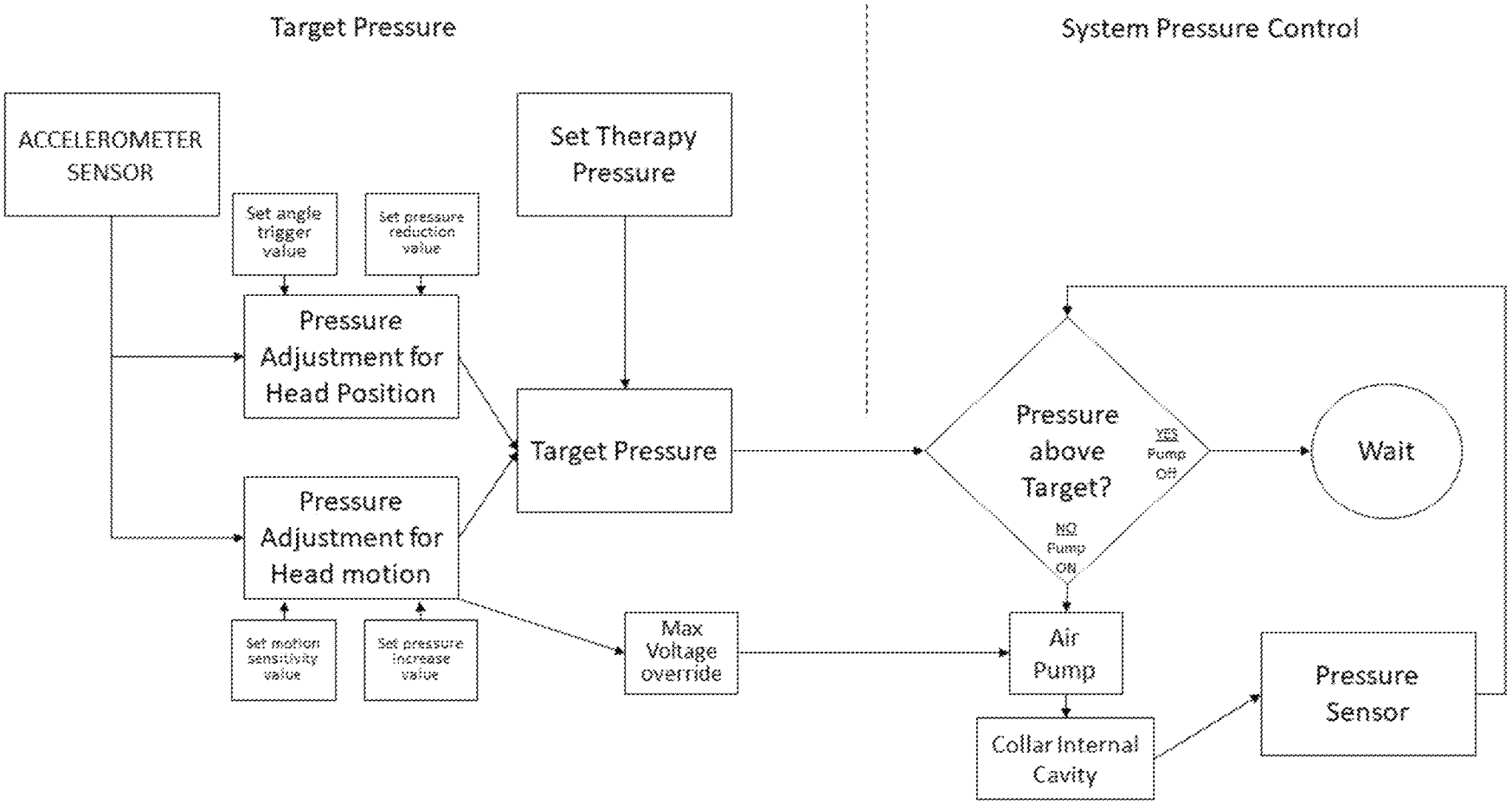

FIG. 11 is a block diagram of an illustrative embodiment of the invention showing the target pressure and system pressure control systems.

Figure 3:
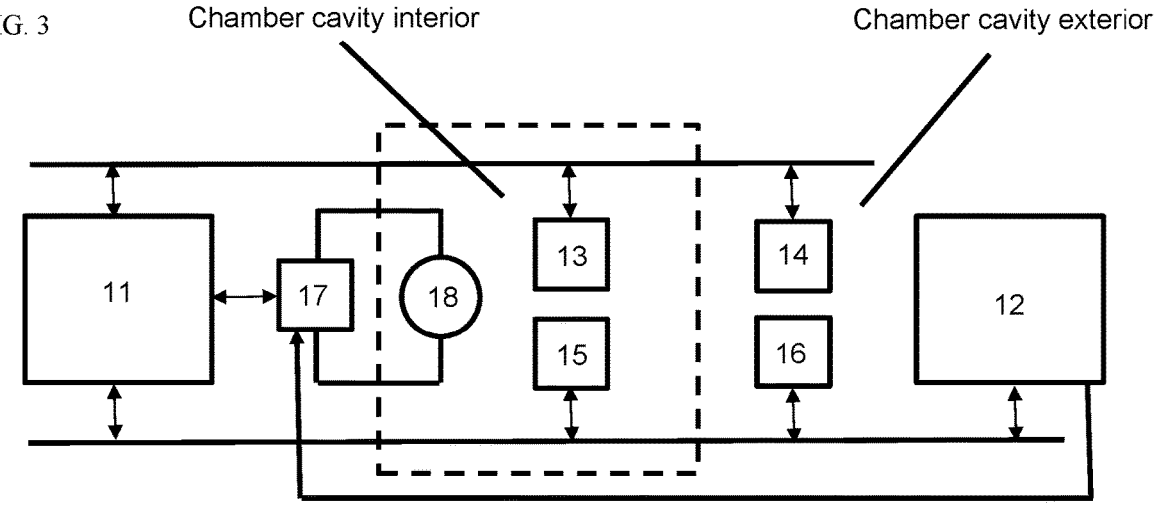
FIG. 3 is a schematic representation of an embodiment of the control system of the invention showing elements within the chamber cavity 22 and elements external the chamber 21, containing; a first pressure sensor internal to the chamber 13 and second pressure sensor external to the chamber 14 operably connected to a first processing element 11 (for a first pressure flow control and primary pressure sensing and pressure setting system) and a third pressure sensor internal to the chamber 15 and fourth pressure sensor external to the chamber 16 operably connected to a second processing element 12 (for a safer sensor system with control and management) operably connected to a switching mechanism 17 which is further operably connected to the air pump 18.
Figure 12:
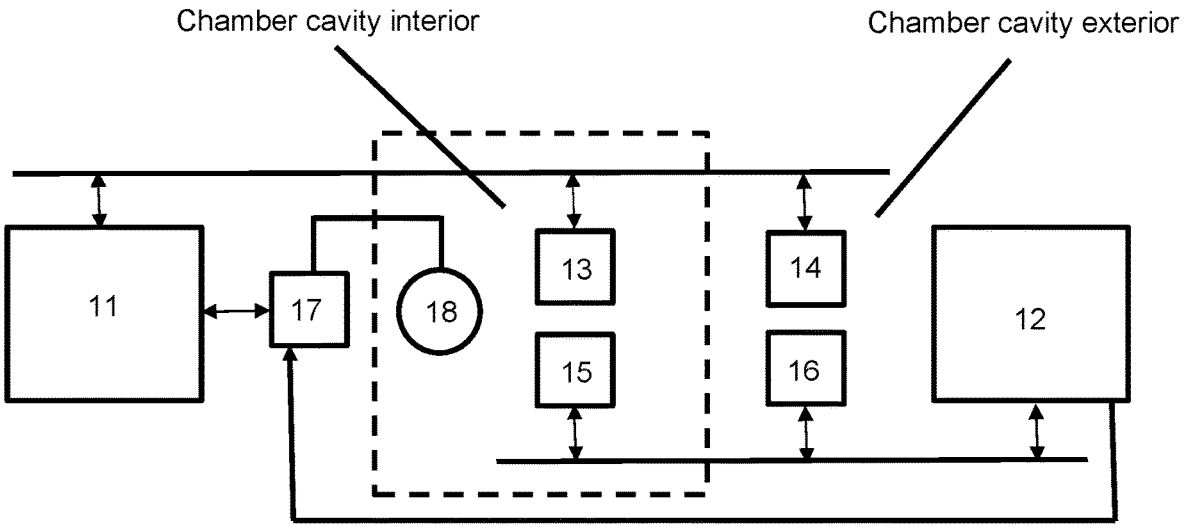

FIG. 12 is an alternative schematic representation of FIG. 3 of an embodiment of the control system of the invention showing elements within the chamber cavity 22 and elements external the chamber 21, containing; a first pressure sensor internal to the chamber 13 and second pressure sensor external to the chamber 14 operably connected to a first processing element 11 (for a first pressure flow control and primary pressure sensing and pressure setting system) and a third pressure sensor internal to the chamber 15 and fourth pressure sensor external to the chamber 16 operably connected to a second processing element 12 (for a safer sensor system with control and management) operably connected to a switching mechanism 17 which is further operably connected to the air pump 18 wherein the first processing element 11 is not operably connected to a second processing element 12.

Figure 13:
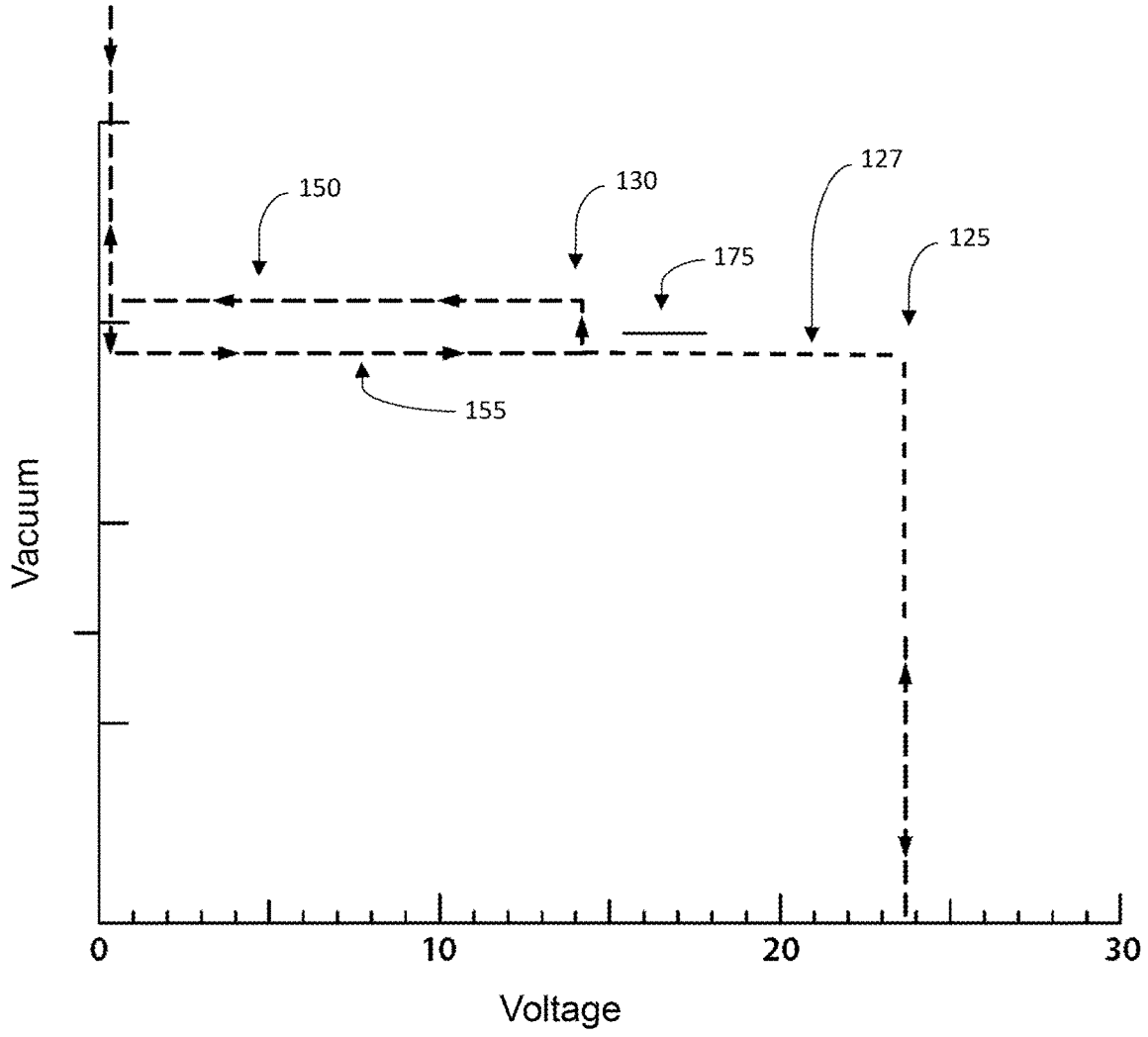

FIG. 13 is a graphical representation of an embodiment of the invention illustrating a pressure control schematic showing negative pressure on the Y-axis and applied voltage on the X-axis, an upper pressure limit 150, a lower pressure limit 155, an approximate therapy voltage 130, a threshold event 127, and a triggering an immediate boost voltage 125.

DETAILED DESCRIPTION OF THE INVENTION

The present invention, and the various features and advantageous details thereof, are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the present invention. The examples used herein are intended merely to facilitate an understanding of ways in which the invention may be practiced and to further enable those of skill in the art to practice the invention. Accordingly, the examples should not be construed as limiting the scope of the invention. In the drawings, like reference numerals designate corresponding parts throughout the several views.

In "negative pressure" therapeutic apparatuses and methods, there is a potential for the negative pressure to reach values above or below that which is required for treatment. These varied values may be induced by body motion that causes variations in chamber volume due to compression and or expansion of the chamber and or movement of tissue into the chamber upon application of negative pressure; leakage that is in excess of any designed ventilation airflow and or that is due to momentary seal disruption; changes in pressure due to temperature change; changes in pressure external to the device caused by changes in altitude, barometric pressure and or changes in external pressure due to external pressurization for example that which occurs within an airplane cabin or hyperbaric chamber; and/or electrical/software malfunction causing an air pump to continue operation to a level that is in excess of a desired level. This is particularly true as the devices are intended for daily wear for many hours under varying conditions during which changes in absolute pressure inside the device may occur; thus, any changes in absolute pressure inside the device must be sensed quickly and responded to by a pressure control system such that increases or decreases in negative pressure can be made to maintain the therapeutic level of negative pressure.

In the present invention, a pressure control system is designed for a negative pressure therapy device that maximizes comfort through smooth and silent air pump operation, device safety and seal efficiency ultimately optimizing device efficacy and user compliance. As used herein user compliance is defined as the users adhearance to usage guidelines. The pressure control system described below for use in a negative pressure therapy device designed for the opening of the upper airway when the therapy device is placed upon the neck of a subject over a surface corresponding to approximately the upper airway of the subject.

An exemplary therapy device for use with the pressure control system of the present invention is shown in FIG. 1A. The therapy device contains a chamber 1 that is used to create a vacuum between an inner surface of the appliance and the skin of the upper neck/chin region. The chamber 1 comprises a flange element 2 along the edge of the flange that provides a contact surface 3 with the wearer to form an enclosed chamber. The chamber 1 may also have an aperture 5 for the insertion of a pressure control system apparatus comprising an air pump and associated control circuitry, and an O-ring like feature 4 around the inner circumference of the aperture to assist in the sealing of the pressure control system apparatus to the chamber 1. The device may be formed, molded, or fabricated from any suitable material or combination of materials. Non-limiting examples of such materials suitable for constructing the therapy appliance include plastics, metals, natural fabrics, synthetic fabrics, and the like. The device may also be constructed from a material having resilient memory such as, but not limited to, silicone, rubber, or urethane.

Figure 1B:
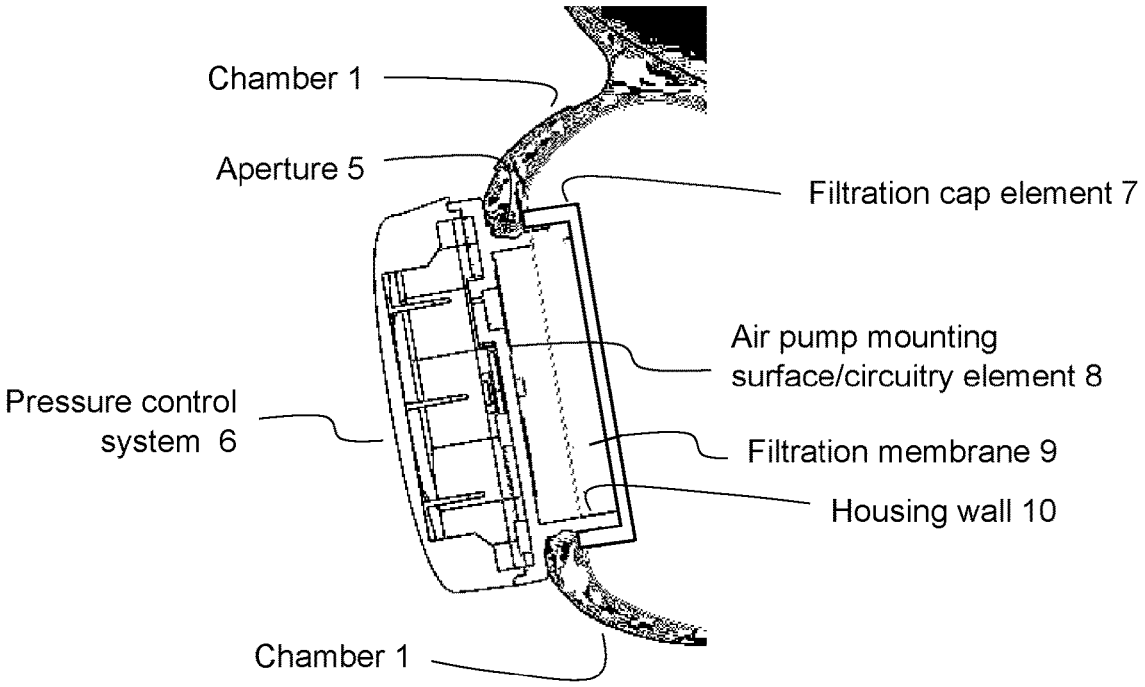
FIG. 1B is a cross sectional view of an illustrative embodiment of a pressure control system apparatus with the air pump/control circuitry housing 6 inserted through aperture 5 of chamber 1 and mounted via a filtration cap element 7 affixed from the inside of the chamber 1. Also shown is the air pump mounting surface/circuitry element 8, filtration membrane 9, and housing wall 10.

An exemplary pressure control system according to the invention is shown in FIG. 1B in concert with the negative pressure therapy device. An air pump housing element 6 is installed through the exterior of the negative pressure therapy device through air pump aperture 5 and affixed via installation of a cap element 7 which encloses housing wall 10. The cap element can comprise a filter element 9 to prevent contamination of the air pump during use. The therapy device is configured to define a chamber element 1 overlying the external surface of a target therapy area and to apply a force to the external surface of the individual when a therapeutic level of negative pressure is applied within the chamber element 1 by the pressure control system.

This exemplary application of the technology is not meant to be limiting. The pressure control system can be used for the measuring of absolute differential pressure across any barrier for example to gauge the absolute differential pressure in a sealed system, i.e. a tank (scuba, propane oxygen etc.) and further based on measured values, execute operations and or profiles stored in non-volatile memory elements that may open valves, energize or de-energize air pumps etc. to control or maintain desired pressures within said sealed system.

Figure 2:
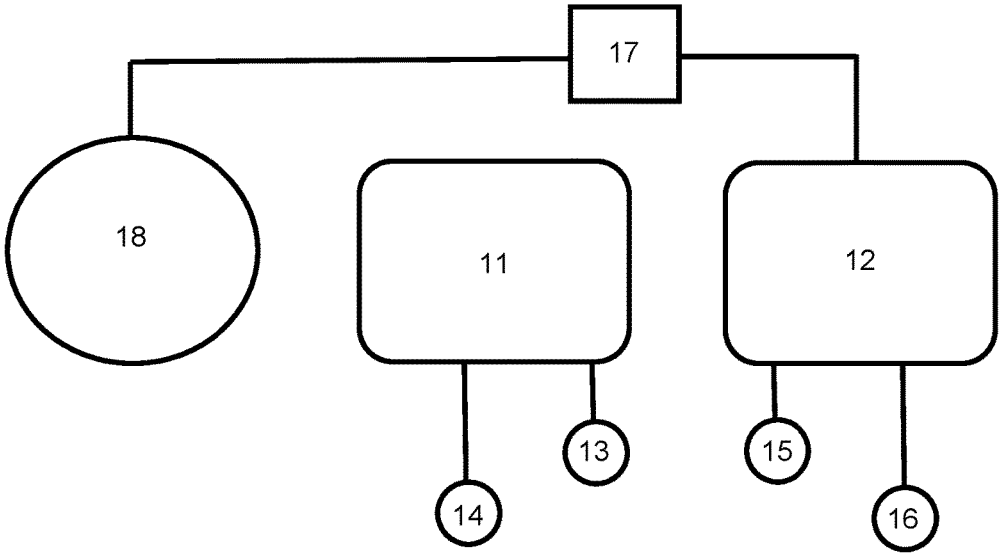
FIG. 2 is a schematic representation of an embodiment of the invention showing the two processing elements, a first processing element 11 for controlling the air pump and a second processing element 12 for monitoring and shutting off the air pump 18, each processing element containing pressure sensors internal and external to the chamber wherein the first processing element 11 is operably connected to a first pressure sensor internal to the chamber 13 and a second pressure sensor exterior to the chamber 14 and wherein the second processing element 12 is operably connected to a third pressure internal to the chamber 15 and a fourth pressure sensor exterior to the chamber 16, wherein the second processing element is operably connected to a switching mechanism 17 which can be used to maintain or terminate drive voltage to the air pump 18.

Schematic descriptions of the pressure control system as used herein are depicted in FIGS. 2 and 3. The control module element as used herein is defined as a component of the therapy device used to control, monitor and or store data of one or more aspects of the device which may contain one or a plurality of single or multi layered circuit boards, one or a plurality absolute pressure sensors, one or a plurality of processing elements and one or a plurality of memory elements (volatile and non-volatile memory elements) operably connected to an air pump. Because the pressure control system apparatus is exposed to both the interior of the vacuum chamber, sensors within the control module element are able to sample both the ambient atmosphere outside the vacuum chamber (element 21 in FIG. 3) with sensors exterior to the chamber (14 and 16, in FIG. 2 and FIG. 3) and within the vacuum chamber (element 22 in FIG. 3, with the separation depicted by a dashed line) with sensors interior to the chamber (13 and 15, in FIG. 2 and FIG. 3).

The control module element may contain additional sensors for the monitoring, storing and reporting of additional parameters to aid in the maintenance of the desired level of negative pressure within the therapy device (FIG. 1). Additional parameters may include, device and or patient position, sounds/vibrations for example those caused by noise, including but not limited to respiratory sounds (snoring and breathing), respiratory rates, pulse rates, blood pressure. Thus, the additional sensors may comprise one or more accelerometers, photoplethysmogram sensors, ECG sensors, microphones or other sensors able to sample audible frequencies, etc., and may be internal (meaning within the vacuum chamber) or external (meaning in the ambient external environment).

The control module element may further contain one or more temperature sensors to monitor, for example, temperature interior and or exterior to the therapy device as well as within the control module element that may aid in the correction of chamber pressure as a function of temperature change or to detect overheating of the control system electronics, pump or associated components.

Air within the chamber element of the device is subject to three sources of heat that may cause a discrepancy between chamber temperature and ambient temperature and affect the readings obtained from the various sensors of the pressure control system. As used herein, chamber temperature is the temperature inside the chamber element while ambient temperature is the temperature outside the chamber. Sources of heat include heat from the electronics, heat from the operation of the pump and heat emitted by the flesh of the user enclosed within the chamber element.

Treatment pressure is ideally unaffected by steady state change in temperature whether from ambient changes or steady heat flow from the system. The differential pressure is not dependent on absolute pressure, which is a function of temperature. The chamber of the instant therapy device has capacities that range from about 155 cc to 300 cc. Therefore, as an example a chamber with an approximate volume of 200 cc has an absolute pressure change of approximately 2 hPa per degree Fahrenheit for zero net air flow.

However, instances may occur where a rise in temperature, "thermal runaway", may occur. As an example, in normal operation the pump of the instant invention is on for short durations that typically vary between 10%-20% of the total usage time with a treatment evacuation flow rate of less than 0.6 liters/min, however in the event of a chamber leak the pump on to off time increases as/when the leak becomes large or continues for long periods of time. The control system of the device can then enable a maximum evacuation flow rate, running the pump continuously at a high flow rate, typically up to about 1.6 liters per minute. In this operation mode, the pump may dissipate up to 2 watts causing the electronics within the control system assembly to rise in temperature. Therefore, in certain embodiments of the invention thermal changes and thermal runaway can be monitored using temperature sensors integrated into the device and in preferred embodiments, absolute barometric pressure sensors integrated with temperature compensating sensors may be used for example the board mouted pressure sensor by ST Microelecctronics part number LPS25HBTR.

In aspects of the device, parameters of the position of the device may be monitored. Position data may be used to indicate when the device is not in use, potentially generating a signal to power the device off, is in use and when in use the position of the device and user. The position data collected when the device is in use may aid in the determination of movement and/or type of movement during the sleep cycle which can further be correlated with other device information, for example changes in chamber pressure and indicate head and or body movement and changes in chamber volume from chamber compression for example when a user rolls onto their side. In additional embodiments position data may be used to turn on or off features of the device for example when the device is in use and the device/user are in a vertical position for example sitting up or standing up, a light could be turned on to aid in visibility in a dark room.

In certain embodiments, position data may be used to change chamber pressure for example, to reflect a need for a different level of negative pressure when the user is on their side and a different level of negative pressure when the user is in a supine position and further to sense movement between a supine and side position and vice versa to adjust pressure to avoid dislodgement of the device during movement. This may aid patient comfort as well as conserve battery life. This technique could also be applied to other airway obstruction therapy devices such as CPAP systems, for example battery powered, fully wearable CPAP systems.

It is an object of the invention to establish and maintain a target pressure, either as a specific pressure or as a target pressure range, of the therapy device. In certain embodiments, it may be desired to modify the target pressure and/or have one or more target pressures in order to optimize therapy delivery, device comfort, maintain device engagement to the therapy location and/or battery life of the device. These target pressure values can be pre-programed and/or set and modified as needed. As used herein, a target pressure value is a selected level of negative pressure to be applied within the chamber given input parameters received by the sensors of the control system and set values of the control system. Input parameters can include but are not limited to: chamber pressure, movement, magnitude of movement and position. Set values of the control system can include varying levels of negative pressure accommodating for angle of the device/user (head position) and varying levels of movement.

Figure 10:
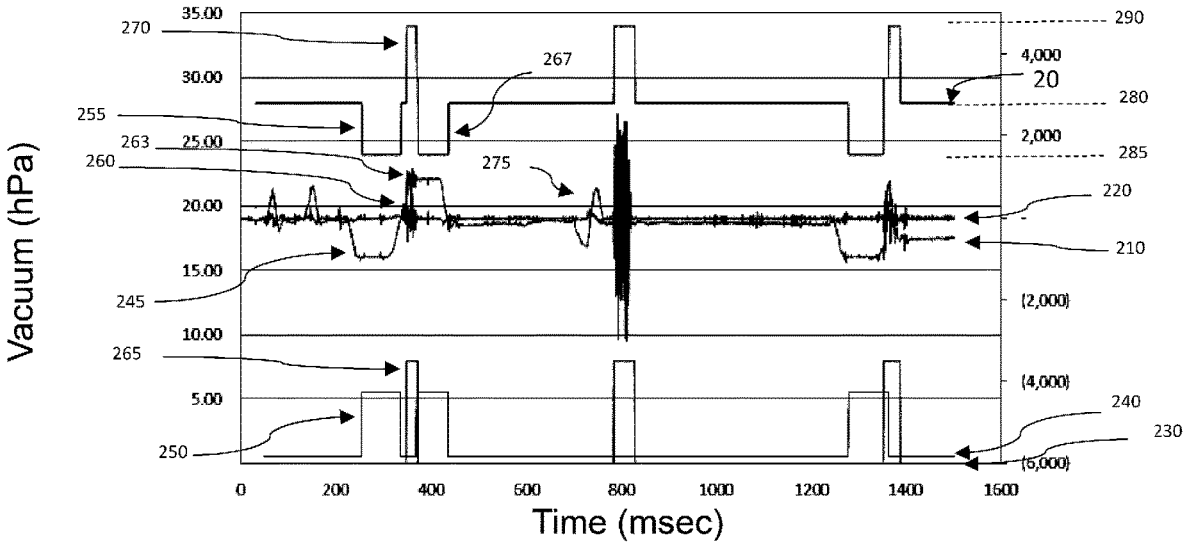
FIG. 10 shows an illustrative embodiment of the inventions functional relationship(s) of accelerometer signals of position and movement to module target pressure signal and target pressure changes. Time is noted on the X-axis; a representation of negative pressure is noted on the left Y-axis and accelerometer force signals are noted on the right Y-axis.

The target pressure may be a therapeutic level of negative pressure (FIG. 10, 280,285) and/or a reactionary level of negative pressure (FIG. 10, 290). The control system may further select from one or more therapeutic levels of negative pressure generally determined by a sustained position of the device and user. For example, a sustained supine level of negative pressure (FIG. 10, 280) and a sustained side level of negative pressure (FIG. 10, 285). As used herein a sustained position is defined as a position that is maintained from at least about 0.5 seconds to about 60 seconds or more. A "sustained position" refers to a position that is maintained for at least 0.5 seconds, preferably for at least 10 seconds, more preferably at leaset 30 seconds, and most preferably for at least 60 seconds or longer. The control system will initiate a target pressure signal based on perceived position and, in instances where the new sustained position is substantially a side position (FIG. 10, 245, 263) (known in the art as a lateral recumbent position), will allow decay of negative pressure, preferably between about 2 and 60 seconds and more preferably about 10 seconds, to a set level of negative pressure corresponding to a side position. As used herein, a target pressure signal is a signal indicating a desired target pressure FIG. 11. Similarly, when the new sustained position is substantially supine, the control system will increase negative pressure preferably within about 0.5 to 5 seconds and more preferably in about 0.5 seconds to a set level of negative pressure corresponding to supine position.

In certain embodiments of the invention, for example in a sustained supine position, wherein gravitational forces upon the upper airway are the greatest, the control system may implement a supine target level of negative pressure (FIG. 10, 280). A supine target level of negative pressure may range from 16 to 45 cm $H_2O$ with a preferable value of approximately 28 cm $H_2O$. Further, in a sustained side position wherein gravitational forces upon the upper airway are generally less than in the supine position, the control system may select a different and lesser level of negative pressure. For example, the control system may reduce the level of negative pressure in a sustained side position (FIG. 10, 285) by approximately 0 to 10 cm $H_2O$ with a preferable value of approximately 4 cm $H_2O$.

In certain embodiments the control system may determine to switch from a sustained supine position level of negative pressure to a sustained side position level of negative pressure as determined by the angle of the device/user (FIG. 10, 210, 220). Transition/switch from a supine level of negative pressure (i.e. a higher level of negative pressure to lower level of negative pressure) can have a set angle trigger value derived in an angular manner wherein a supine position may be defined as a measured angle of between about 0 to about 70 degrees with a preferred angle of about 45 degrees or less. Transition from a side position level of negative pressure to a stronger supine level of negative pressure may be in a linear manner, or determined using a trigonometric function, for example, a sinusoidal transition from low to high vacuum.

The control system may also select one or more reactionary levels of negative pressure (FIG. 10, 270, 290). As used herein a reactionary level of negative pressure is defined as a level of negative pressure selected to maintain position of the device on the user during a level of movement that exceeds a threshold. Reactionary levels of negative pressure may exceed therapeutic levels of negative pressure and is generally in response to exceeding this threshold movement (FIG. 10, 260, 265). Movement can be sensed by motion sensors (e.g., accelerometers such as single- or multi-axis accelerometers) included as part of the pressure control system. Threshold movement (FIG. 10, 260, 265) as used herein is defined as a change in gravitational forces observed by the accelerometers of the control system (FIG. 10, 210, 220) that exceeds a selected value or range of values. A threshold movement can include, but is not limited to, momentary movements such as head movement, coughing, sneezing, speaking and or rolling over from supine-to-side and or side-to-supine that is determined by the control system to have breached a threshold acceleration value. Threshold accelerometer static values that can trigger a reactionary level of negative pressure range from approximately 0.1 G/sample to 0.8 G/sample and more preferably approximately 0.3 G/sample with a frequency of sampling between about 1 Hz to about 10 Hz and more preferably between about 1.5 Hz to about 6 Hz. Derivative values of the static accelerometer levels can also be used as a trigger threshold.

Increases in negative pressure during threshold movement can exceed therapeutic levels of negative pressure FIG. 10, 270 by approximately 2 cm $H_2O$ to approximately 10 cm $H_2O$ and preferably about 5 cm $H_2O$ at a rapid rate. When a movement is categorized as exceeding a threshold the control system will apply maximum voltage to the air pump and increase negative pressure in preferably between 0.5 to about 5 seconds and more preferably about 0.5 seconds to a set level of negative pressure corresponding a reactionary level of negative pressure until such time as the threshold movement ceases. When threshold movement is no longer sensed, the control system will select from one or more target therapy values, for example side or supine, and allow the negative pressure to decay to the new target therapy value and maintain the new value.

Rates of change of negative pressure within the chamber in order to address changes in position and movement may also be regulated by the control system, for example, in instances of a desired reduction of negative pressure, the air pump may remain in an "off" state to allow for a designed airflow to gradually reduce the level of negative pressure within the chamber. In instances where a slower reduction in negative pressure is desired, the air pump may be activated at less frequent intervals or lower levels voltage can be applied to the pump creating less vacuum to lessen the rate of decrease of negative pressure. In instances where an increase in negative pressure is desired, for example when a change in sustained position from side-to-supine occurs, the rate of the increase of negative pressure wants to happen rapidly from a therapeutic level of voltage applied By way of example, FIG. 10 shows an illustrative embodiment of the inventions functional relationship(s) of accelerometer signals of position and movement to module target pressure signal and target pressure changes. Time is noted on the X-axis; a representation of negative pressure is noted on the left Y-axis and accelerometer force signals are noted on the right Y-axis. 200 shows a trace of a target pressure over time, 210 shows a trace of data received from accelerometers regarding magnitude of movement and position over time, 220 shows a trace indicating the derivate of the data of trace of 210 over time, 230 shows a trace of threshold movements over time and 240 shows a trace non-threshold movement over time. 245 shows a non-threshold movement 250 corresponding to a change in sustained position from supine to side corresponding to a change in target therapy pressure 255, 260 is an example of a threshold movement 265 corresponding to a change in position from side through supine to an opposite side triggering a reactionary target pressure 270, when threshold movement ceases 263, the control system returns to a target therapy pressure corresponding to a side position 267. 280 corresponds to a supine target pressure, 285 corresponds to a side target pressure and 290 corresponds to a reactionary target pressure.

In further aspects of the invention parameters of sounds/vibrations during use of the device may be monitored.

Sounds and vibrations, as used herein can be characterized in terms of amplitude, velocity and acceleration. Sounds and vibrations may include respiratory sounds for example snoring and breathing and yield further information on respiratory rates as well as depth and length of respiration. Sound and vibration data may also include those obtained as a result of pulse and blood pressure, for example when a device, for example the therapy device of the instant invention is placed on the treatment area approximately over the upper airway of the patient, the vibration of a palpable carotid pulse can be monitored and used to assist in the determination of those rates and pressures.

In certain embodiments parameters of position and sound/vibration data may be obtained by one or more sensors that can monitor low frequency signals, middle-range frequency signals, and higher frequencies and may include MEMS devices (Micro-Electro-Mechanical System) such as amplitude sensors, velocity sensors, accelerometers and so on. In preferred embodiments a MEMS-three axis accelerometer is used.

The control module element may further contain means of transferring information to and from the device via any suitable means, for example data ports, or wired or wireless (e.g., Bluetooth, wi-fi, ZigBee, etc.) type interfaces. This allows for the upload and download of data and or device parameters either to or from a wired device for on-site interfacing or via a network that allows for remote access of the device. Safety systems or programs may also be used to avoid unwanted tampering with software parameters, data and so on.

In aspects of the device, sensors, microprocessors, and other components may be integrated into a circuit board, silicon integrated circuits and/or printed circuit board (PCB). As used herein, a PCB is an element that mechanically supports and electrically connects electric components of the control module. Conductive sheets, typically copper layers, are laminated onto a non-conductive substrate and can be single sided, double sided or mulit-layered, providing a platform for any type of electric component. Conductive tracts, pads and other features can be etched into or integrated within the circuit board and control elements such as capacitors, resistors and active devices such as pressure sensors for example, digital output barometers, processing elements and memory elements can be affixed and operably connected. The circuit board or components/features located thereon can be operably connected to the air pump and a power source to activate, deactivate and regulate device function.

In aspects of the device, one or more pressure sensors are used to measure absolute pressures inside (FIG. 3, 22) and outside (FIG. 3, 21) the chamber element to generate an actual differential pressure. By measuring the absolute pressure inside and outside the chamber element, accurate chamber pressure values can be obtained regardless of altitude or barometric pressure. In certain embodiments of the device, absolute output barometers are used to measure pressure within a given space and generate an output signal indicative of an absolute pressure in the form of a time-dependent waveform. The time dependent waveform may be analogue or digital. However, analogue waveforms generally require additional processing making digital waveforms preferable. Further, the absolute output barometers may also be analogue or digital output barometers however in certain embodiments absolute digital output barometers are preferred.

In further aspects of the invention the device contains two absolute output barometers, the first absolute output barometer 13 being positioned on a first surface within the chamber element to measure the absolute pressure within the chamber element and provide a first time-dependent waveform and the second absolute output barometer 14 positioned on a second surface external the chamber element to measure the absolute pressure external the chamber element and provide a second time-dependent waveform.

The first 13 and second 14 output barometers are operably connected to a first processing element 11 configured to receive the first and second time dependent waveforms from the first and second digital output barometers. As used herein a processing element can be digital or analogue signal processor in the form of a specialized microprocessor containing architecture optimized to process the signals of the absolute output barometers for example calculate a time-dependent value for the negative pressure within the chamber element which is relative to the absolute atmospheric pressure external to the chamber element.

In aspects of the invention the various data and device parameters must be collected stored, uploaded, downloaded and or modified as needed to maintain the therapeutic level of negative pressure within the device. The data and device parameters may be stored in any suitable manner including, non-volatile memory, volatile memory, SRAM (static random access memory) and or DRAM (dynamic random access memory).

The memory can be stored and utilized in any appropriate manner, interfaced via wired or wireless means, however, in preferred aspects of the invention non-volatile memory is used. Non-volatile memory is a type of digital/computer memory that can be stored and retrieved even after having power cycled off and on. The non-volatile memory of the present invention can store a predetermined range for the therapeutic level of negative pressure to be applied within the chamber.

A principal aspect of the pressure control system is to act as a portion of the negative pressure device that ensures safe and effective application of treatment, i.e., the application of an approximate constant negative pressure on a target therapy area. The control system must also accommodate the lagging effect caused by the influence of a previous event on future events. This is achieved through the sample rate(s) of the pressure and parameter affecting pressure and response rate of the pump. An approximate constant negative pressure 175 is accomplished by monitoring parameters that affect absolute pressure within the chamber, the absolute pressure of the chamber and then controlling pump activity in response to the variables as they affect said chamber pressure to achieve the constant and future goal of the approximate target pressure.

In examples of the control system, the device, once treatment commences, either has the pump "on" evacuating air to the target pressure, "on" in response to controlled ventilation and or "on" in response to an event affecting the target pressure or further "off" allowing a release in pressure. As used herein having the pump "on" may include supplying a voltage to the pump and further supplying voltage to the pump as a voltage in an increasing fashion for example as a linear voltage ramp and or curved voltage ramp until the operating voltage is reached. Further, having the pump "on" may also include equivalent scenarios wherein a vacuum source provides a necessary negative pressure and vacuum pressures/flow rates are controlled via valves or other adjustable methods, etc.

Achieving and maintaining the target pressure is therefore a function of the response time of the software that controls the pump and the sampling rate of the chamber pressure, sampling rate of ventilation flow and flow rate of the pump. As an example, a delay in detecting a given pressure may either allow the pump to evacuate too much air and exceed an upper pressure threshold value or not turn the pump on quickly enough and possibly allowing the ventilation flow to take the differential pressure below the lower threshold value.

The control system must balance the desire for a pump to evacuate as much air per unit time, consistent with events that can temporarily break the chamber seal, for example head movement, (including but not limited to talking, coughing, sneezing, swallowing, etc.) with the desire of, as well as, allowing a ventilation flow of air that aids in making the device as comfortable for the wearer as possible. The change in the pressure within the chamber is further determined and or affected by several parameters, including but not limited to, the volume of the chamber wherein the larger the volume the more air that must be evacuated to achieve a given differential pressure; the rate of ventilation flow wherein the greater the flow the more air lost per unit time and the rapider the pressure will drop; the rate of pump flow wherein the more air moved per unit time the quicker the differential pressure will increase; the response time of the pump consisting of the time for the pump to go from maximum flow to zero flow and the time for the pump to go from zero flow to maximum flow; and the response time of the pressure sensors as represented by their sampling rate(s), for example the amount and rate of air either entering the chamber or being evacuated from the chamber must be such that in one sampling period the pressure change due to airflow cannot exceed the acceptable pressure range.

Further it may be desirable for the control system to operate the pump "harder" at certain times to reach a desired vacuum level rapidly, for example at start up or in the presence of an undesirable leak when a larger deviation from a set allowable pressure range is sensed and the control system should operate the pump more "gently" when the vacuum level is closer to the set allowable pressure range. As used herein, operating the pump "harder" is defined by having a higher voltage supplied to the pump causing a more rapid decrease in chamber pressure and operating the pump more "gently" is defined as having a lower applied voltage causing the pump to operate slower or simply stop resulting in a slower decrease in chamber vacuum.

As an example, a control system programed with a target pressure with a variability of about +/−2 hPa and an allowable error of less than about 0.5 hPa(s) and a sample rate of about 25 Hz, the change in pressure is equivalent to about 12.5 hPa/second. Therefore, to avoid reaching pressure values outside the desired range, this implies that the pressure must not increase from the minimum target pressure of about minus about 2 hPa to the maximum target pressure level of about plus 2 hPa at about 12.5 hPa/sec in greater than about 320 milliseconds (about 4 hPa to about 12.5 hPa/sec). Alternatively, in this example, maintenance of the desired pressure levels can also be achieved by the pump evacuating less and or increasing the sampling rate. In preferred embodiments the sampling rate is greater than about 25 Hz and in more preferred embodiments the sampling rate is about 50 Hz, about 70 Hz, about 200 Hz or greater.

Therefore, the pressure control system benefits from rapid sampling of all influencing parameters and subsequent modification of pump activity to accurately predict, modify and maintain the target pressure within the chamber of the negative pressure therapy device as necessary. The pressure control system monitors a variety of parameters to determine if the actual pressure goes below 155 or above 150 the approximate target pressure range and in instances where actual pressure diverges from desired target pressure ranges and or reaches a maximum allowable negative pressure threshold (FIG. 9, 152) turns on, turns off or modifies the steepness of a voltage ramp to the air pump until such time as the actual pressure returns to a desired predetermined range, i.e., target pressure.

The target pressure range may have a maximum value, a minimum value and a midpoint value. In aspects of the present invention the maximum and minimum pressure values are within about +/−2 hPa of the target pressure/midpoint value. In certain embodiments of the invention the midpoint value is between about 10 hPa and about 60 hPa, between about 20 hPa and about 50 hPa, between about 25 hPa and about 35 hPa and in preferred embodiments the midpoint value is about 30 hPa.

Maintenance of the approximate therapeutic level of negative pressure (i.e. target therapy pressure +/−an acceptable range) within the chamber element within the predetermined target pressure range may be achieved through the storage of flow rate profiles in the storage memory wherein a first profile is configured to energize the air pump when a minimum value is reached and turn off the air pump when a maximum value is reached. Flow rates are controlled by the application of a voltage to the air pump 18 and the method by which the voltage is applied. In aspects of the invention the first profile 165 is configured to energize the pump when the minimum negative pressure 155 value is reached by applying a suitable operating voltage to the air pump, wherein the flow rate of the air pump increases with the higher applied voltage and a second profile 170 is configured to de-energize the pump when the maximum value is reached by removing the voltage 110 applied to the air pump 18 wherein the flow rate of the air pump decreases with the lower applied voltage.

The control system is configured to drive the air pump 18 in a manner that maximizes battery life and does not arouse the patient. Battery life is compromised in situations where voltage to the pump is applied for excessive periods of time and arrousal events can occur from sounds from the air pump 18 as a result of the of application of rapid large voltage changes. Also, high rates of pressure change and pulses that are felt by the user can cause arousals. In examples of the invention where a discontinuous pump is used, voltage is (cycled) applied 100 and removed 110 to the air pump 18 to maintain an approximate level of therapeudic negative pressure 175. Low flow rates can minimize pressure pulses. Reducing the pump noise felt and heard by the user requires voltage changes to be applied to the air pump 18 over a reasonable period of time in order to achieve the desired level of negative pressure. High flow rates achieved by the application of high voltage to the air pump 18, can reach the desired level of negative pressure more rapidly. However for this case, the air pump 18 should be cycled off and on rapidly to avoid exceeding the upper pressure limit 150 and or maximum upper pressure limit 152 or causing to rapid a change in vacuum which would be felt by the user. Rapid application of a large voltage change to the pump can also have the undesirable artifact of pump noise in the form of audible clicking.

In an embodiment of the invention the balance of battery life, pressure pulses and pump noise is therefore balanced though controlling the method by which voltage is applied to the air pump 18. This may be accomplished through a method of applying voltage to the air pump for example through the application of voltage control algorithms. As used herein a voltage control algorithm is a set of rules stored in the processing element of the device that operate the air pump by applying 100 or removing 110 voltage to the air pump 18 using one or more voltage ramps (165, 170) in response to pressure sensor measurements received from the absolute pressure sensors. In an embodiment of the invention there may be one or more voltage control algorithms and voltage ramps associated with successful air pump operation.

Figure 4:
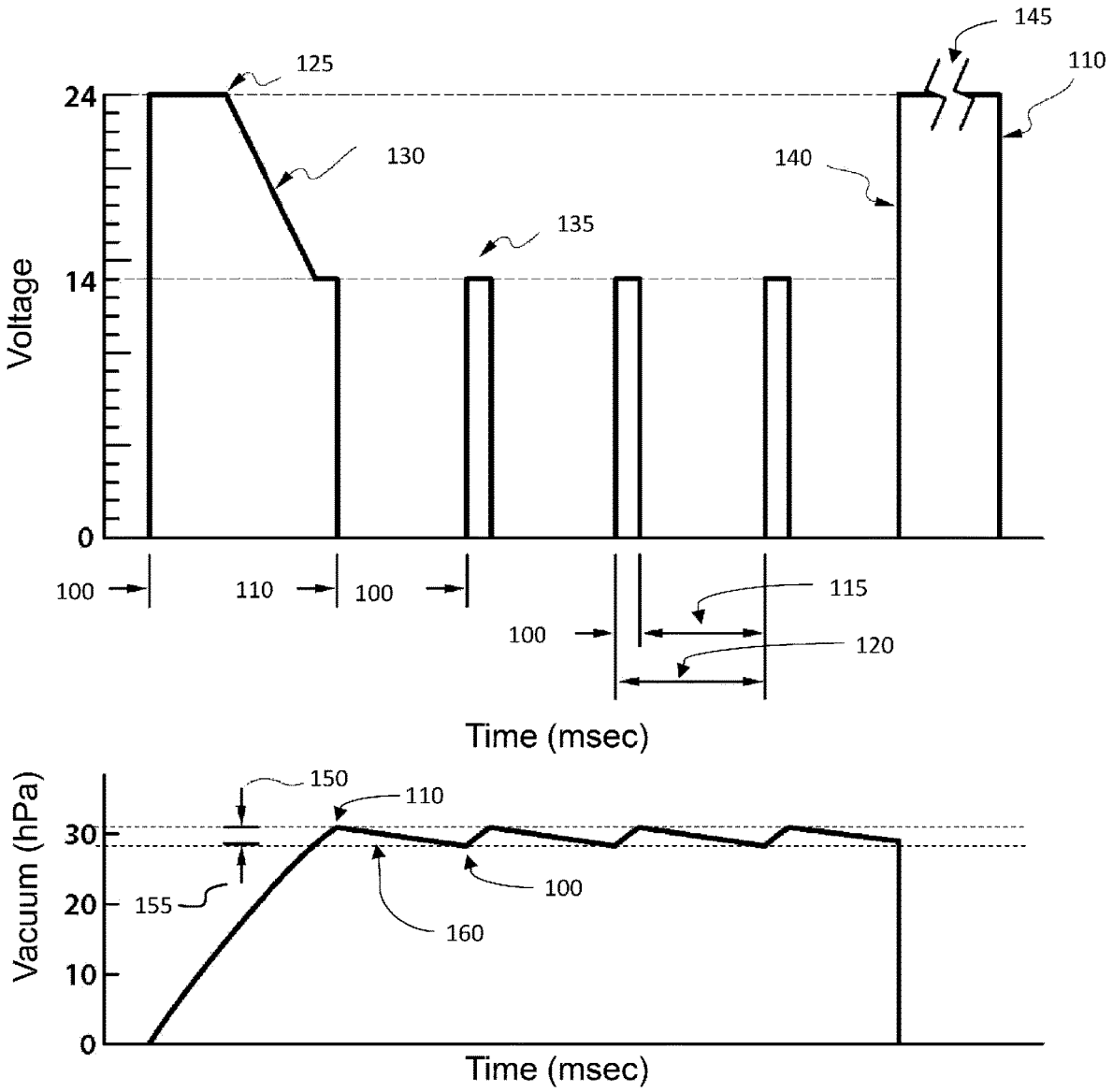
FIG. 4 is a graphical representation of an embodiment of the invention showing approximate voltage applied to the air pump over time (upper graph) and resulting chamber vacuum levels. In the Figure, pump on/voltage applied to the pump is shown 100, pump off/voltage removed from pump is shown 110, a pump off time 115, a pump period 120, boost voltage 125, therapy voltage 135, loss of vacuum event 140, time out period 145, upper pressure limit 150, lower pressure limit 155 and pressure increase due to air flow and pump off time 160.
Figure 5:
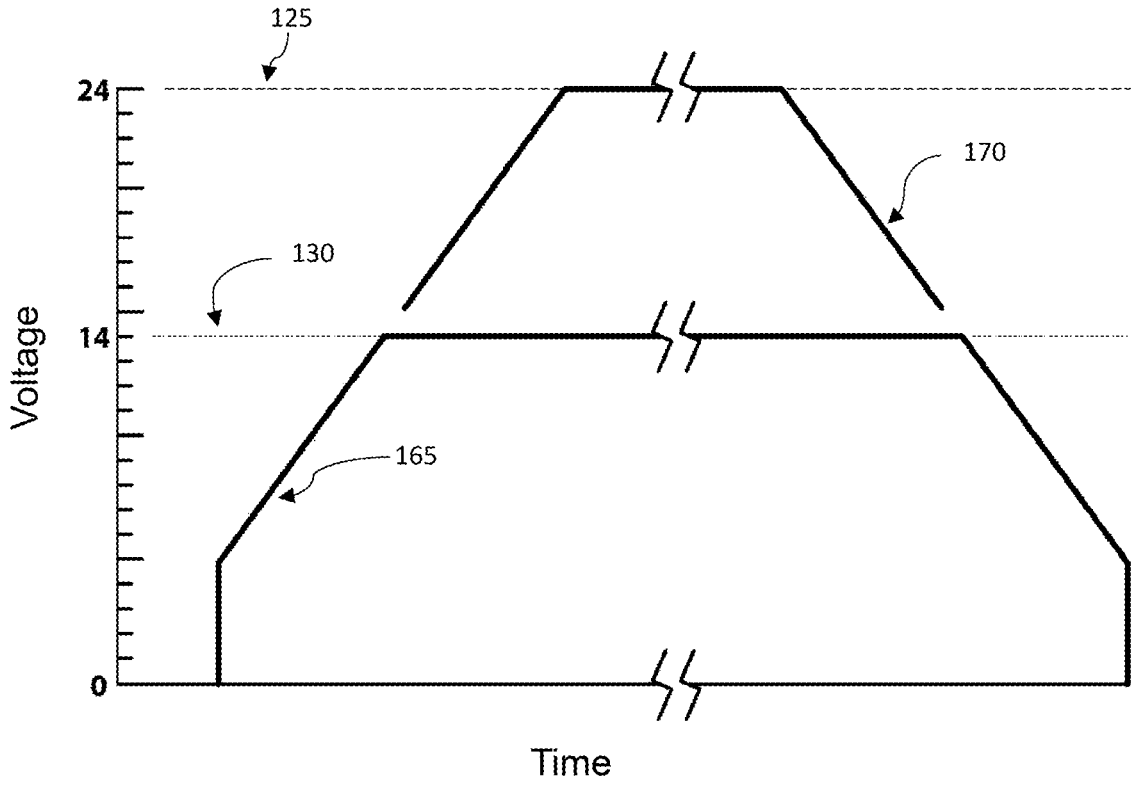
FIG. 5 is a graphical representation of an embodiment of the invention showing an approximate increasing and decreasing voltage ramp as applied voltage as a function of time. In the figure, the increasing ramp voltage applied to the air pump is approximately proportional to the decreasing ramp voltage applied to the air pump. The desired therapy voltage is shown as dashed line 130, a boost voltage is shown as dashed line 125, an increasing voltage ramp is shown as solid line 165, and a decreasing voltage ramp is shown as solid line 170.
Figure 6:
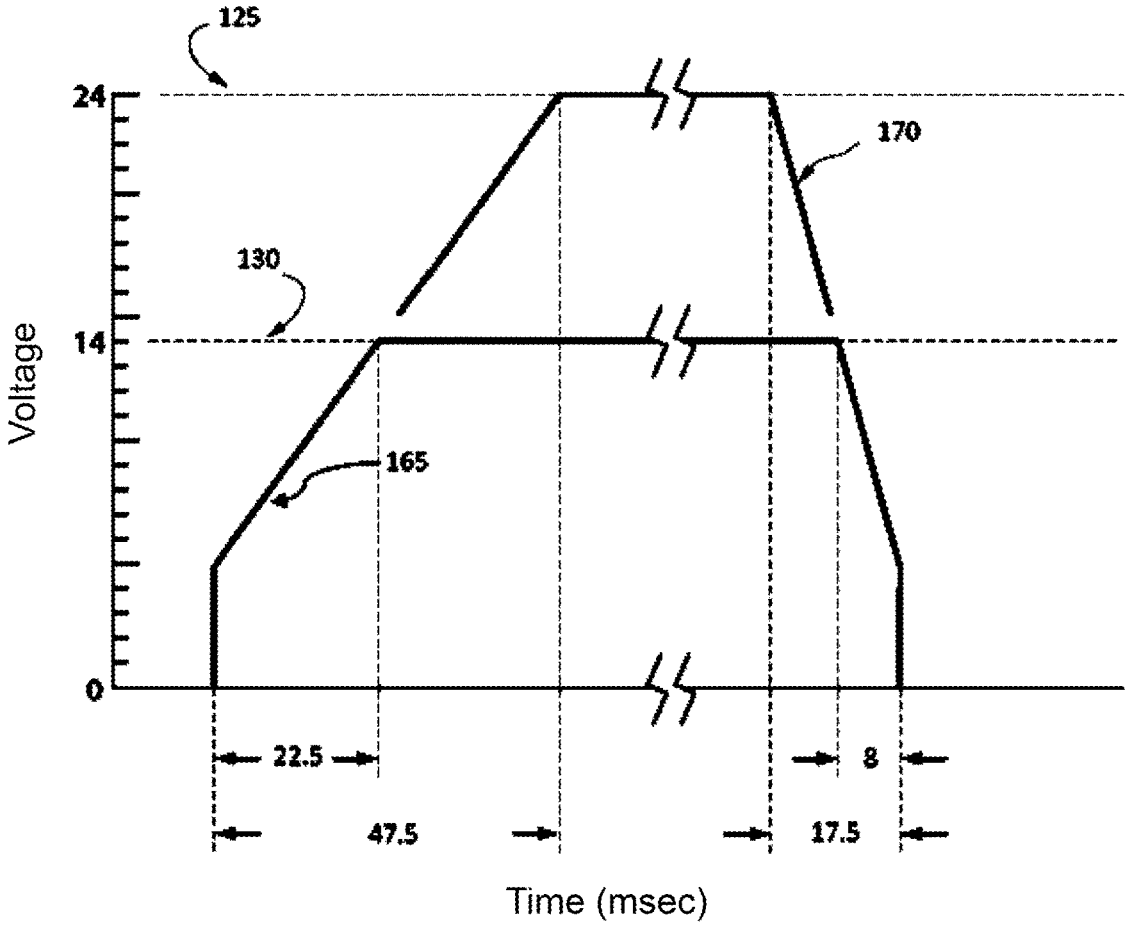
FIG. 6 is a graphical representation of an embodiment of the invention showing an approximate increasing and decreasing voltage ramp. In this case, the increasing ramp voltage applied to the air pump is not proportional to the decreasing ramp voltage. The desired therapy voltage is shown as dashed line 130, a boost voltage is shown as dashed line 125, an increasing voltage ramp is shown as solid line 165, and a decreasing voltage ramp is shown as solid line 170.

In one example of a control algorithm and operation of the control system, an appropriate starting or stopping voltage ramp is applied when the controller signals to turn the air pump on and off (to either increase or decrease air flow in the chamber respectively). The voltage ramp and an appropriate voltage ramp, as used herein is defined by a increase or decrease in voltage applied to the air pump, either in a liner or non-linear fashion that is able to operate the air pump in a manner that minimizes or eliminates audible sound from the air pump, mimimizes or eliminates pressure changes that may arouse the user and maximize battery efficiency. Examples of possible voltage ramps can be seen in FIG. 4 and FIG. 5 wherein the increasing voltage ramp 165 and decreasing voltage ramp 170 can be either liner or non-linear, to reach the therapy pressure voltage 130 or boost pressure voltage 125. The voltage ramps may also be proportional wherein the increasing voltage ramp FIG. 5, 165 is the exact opposite as the decreasing voltage ramp FIG. 5, 170, or disproportional wherein increasing voltage ramp 165 is different than the decreasing voltage ramp FIG. 6. 170.

The voltage is applied, via a voltage ramp 165, to reach a boost voltage 125 or therapy voltage 130 depending on the value of the absolute pressure in the chamber. In embodiments of the control system a boost voltage, 125 is typically applied upon startup of the device or the onset of an air leak that causes pressure to drop below the boost pressure threshold 180 in order to rapidly reach the approximate target therapy pressure of the device while achieving or re-achieving a seal between the user and the therapy device. When the correct approximate therapy pressure is achieved FIG. 6, 175, the control system will, in instances where boost voltage 125 has been applied, ramp the voltage down the therapy voltage 130 and/or maintain the therapy voltage until the pressure in the chamber exceeds the upper therapy pressure limit 150. When the approximate upper therapy pressure limit 150 is reached or exceeded the control system will lower the applied voltage from either the boost voltage to the therapy voltage or from the therapy voltage to approximately zero volts via a decreasing voltage ramp 170, until such time as the lower therapy pressure limit 155 is detected via the absolute pressure sensors. When the lower therapy pressure limit 155 is detected, voltage is re-applied to the pump via an increasing voltage ramp and the process continues and cycles in approximately above noted manner. As used herein, approximately zero volts, refers to the lowest possible votage that can be deliverd to the air pump with the control system wherein certain instances the voltage is zero, or the lowest possible voltage is dictated by the parameters of the control system circuitry and by the charge of the power supply/battery. Approximatly zero volts eliminates the airflow by the pump or reduces the airflow of the pump to a neglidgeable value.

Any negative pressure source may be used, however, in preferred embodiments a piezo-oscillatory pump is employed. Piezo-oscillatory pumps with an internal pumping motion operating at a frequency greater than about 500 Hz may exhibit an undesirable acoustic footprint (noise) that can be heard or felt by a user (typically greater than about 20 dBA) when a large voltage change is simply applied. For example, turning a piezo-oscillatory pump on, operating at a frequency greater than about 500 Hz, about every 1 to 5 seconds by applying a pump treatment voltage of about 14 volts with a quickly applied voltage change impulse can produce an undesirable audible noise similar to clicking sounds that can be disruptive to sleep. Therefore, to reduce the acoustic response to the impulse from the pump start and stop to a non-discernable level, voltage and hence flow rate profiles of the pump are controlled by shaping the voltage increase/decrease over time delivered to the pump, specifically through the usage of voltage ramps. Increasing the voltage over about 10 milliseconds to about 100 milliseconds can alleviate these audible clicks. As used herein a voltage ramp can be a curved or a linear increase or decrease in the voltage applied to the pump over time. Curved voltage ramps may be observed as sigmoidal where initial increase or decrease in voltage is slow followed by a rapid increase or decrease in voltage and followed by a final slow increase or decrease in voltage respectively.

In certain embodiments, when a target voltage is reached, the control system may maintain the voltage at an approximate constant value (for example the boost voltage of about 24 volts or the therapy voltage of about 14 volts) until such time as pressure parameters indicate that a decreasing voltage ramp should be applied. For example, the control system may maintain a constant voltage of 14 volts for 10 milliseconds before applying a decreasing voltage ramp in response to reaching an upper pressure threshold. In a further embodiment the applied voltage could cycle quickly using appropriate voltage ramps from a higher to a lower voltage, and vice versa (voltage modulation) around the target therapy voltage. For example, the average voltage of 14 volts can be achieved via increasing and decreasing the voltage from about 8 volts to about 18 volts. These types of voltage modulation can achieve similar air flow through the chamber as applying a constant voltage providing a gentler pumping action and thus achieve lower pressure change effects whilst also operating at a more efficient maximum applied voltage in order to extend battery life of the therapy device.

In certain embodiments of the invention, a chamber with an approximate volume of about 200 cc to about 300 cc, a voltage ramp using about 100 volts/second to about 1000 volts/second, a voltage ramp of about 200 volts/second to about 800 volts/second and in preferred embodiments a voltage ramp using approximately 400 volts/second is used. Further, typical ramp times may range from approximately 5 milliseconds to about 500 milliseconds, about 10 milliseconds to about 250 milliseconds and in preferred embodiments about 15 milliseconds to 20 milliseconds respectively is used. Voltage ramps are utilized to achieve effective treatment voltages. By way of example, when the air pump is activated from either initial startup, when the device is placed on the target therapy area and turned on (when there is no negative pressure in the chamber) or when the processing elements receive input from the absolute pressure sensors that indicate a drop in chamber pressure below the lower negative pressure threshold (approx. less than 28 hPa) FIG. 7, 155, through a gradual decay 157 to the boost pressure threshold (approx. less than 15 hPa) FIG. 6, 180, or a signal from the accelerometers indicating a threshold event FIG. 13 127. The control unit signals to apply an initial voltage between about 2 volts to about 10 volts and preferably between about 5 volts and 7 volts, The voltage then continues increasing at a rate between about 100-1000 volts/second and preferably at a rate about 400 volts/second with a typical ramp time between about 5-500 milliseconds, 10-25 milliseconds and more preferably about 15-20 milliseconds to a therapy voltage of approximately 14 volts or to a boost voltage of approximately 24 volts depending upon the pressure within the chamber. Pressure sampling occurs at a rate of about 25 Hz or greater. Boost voltage is only maintained until such time as a pressure reading indicates negative pressure in the chamber to be within the therapy pressure range. These values may be scaled up or down depending upon size of chamber, speed of pressure sampling, speed and size of the air pump and so on.

Figure 7:
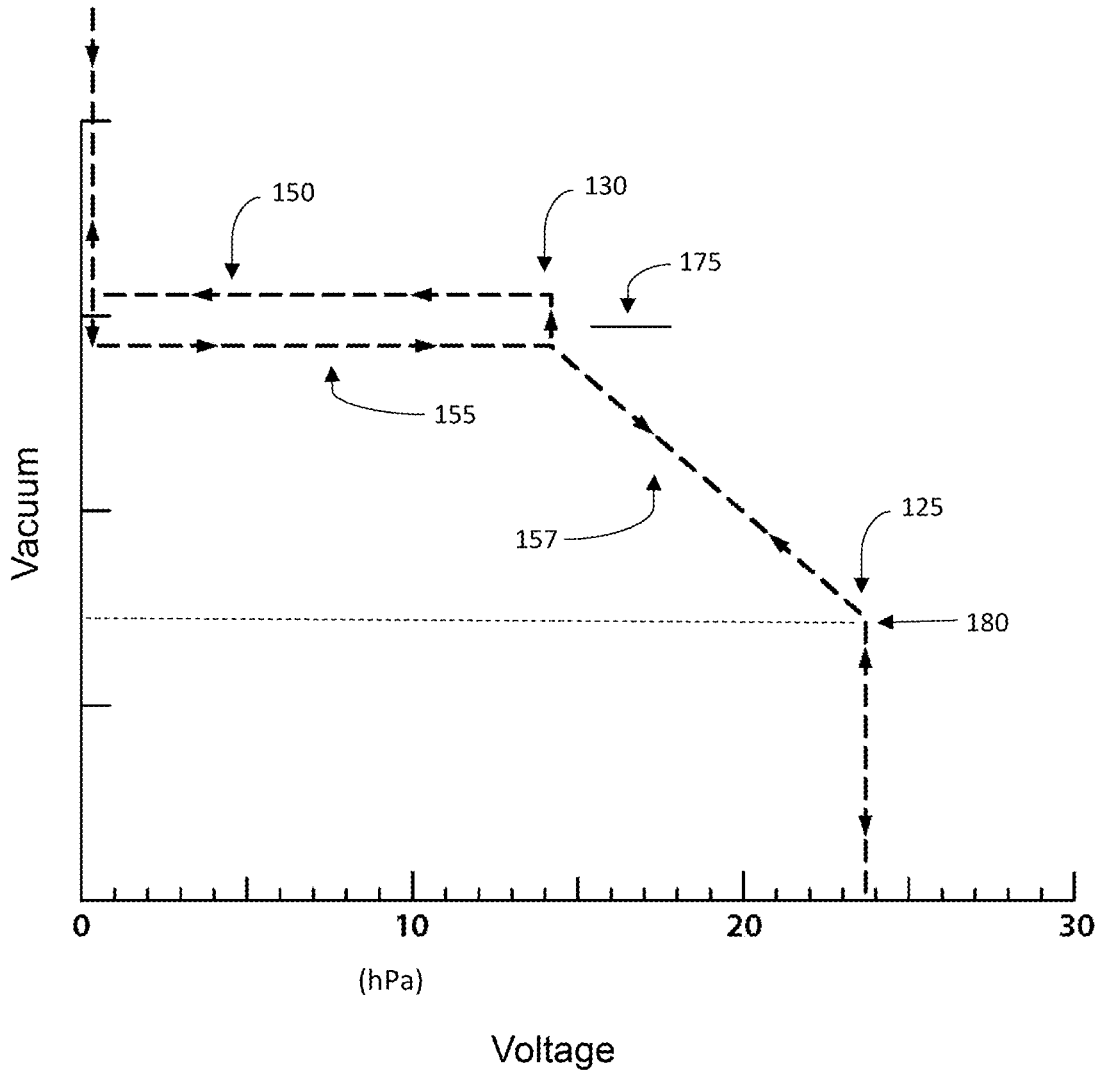
FIG. 7 is a graphical representation of an embodiment of the invention illustrating a pressure control schematic showing negative pressure on the Y-axis and applied voltage on the X-axis, upper pressure limit 150, lower pressure limit 155, approximate therapy voltage 130, a gradual pressure decay 157 to a boost voltage pressure 180 and triggering a boost voltage 125.

In a further example of the control system the therapy voltage used to maintain the negative pressure within the approximate target therapy pressure range FIG. 7, FIG. 13 175 is chosen to minimize excessive overshoot of the upper pressure limit 150 while allowing for a gentler and less perceivable operation of the air pump while in use. In FIG. 7 and FIG. 13, the pump switches on at startup where the voltage ramps up (FIG. 5, FIG. 6, 165) to the 24V boost voltage, 125. When the chamber vacuum reaches the threshold boost pressure 180, the voltage ramps down (FIG. 5, FIG. 6, 170) to the normal operating voltage around 14V, FIG. 7, FIG. 13, 130, and stays at this voltage until the upper pressure limit, 150, limit is reached. At this time, the voltage ramps down (FIG. 5, FIG. 6, 170) to zero. These upward and downward voltage ramps may be adjusted to further reduce patient perceptibility and may or may not be proportionate and may be linear and or non-linear.

Figure 9:
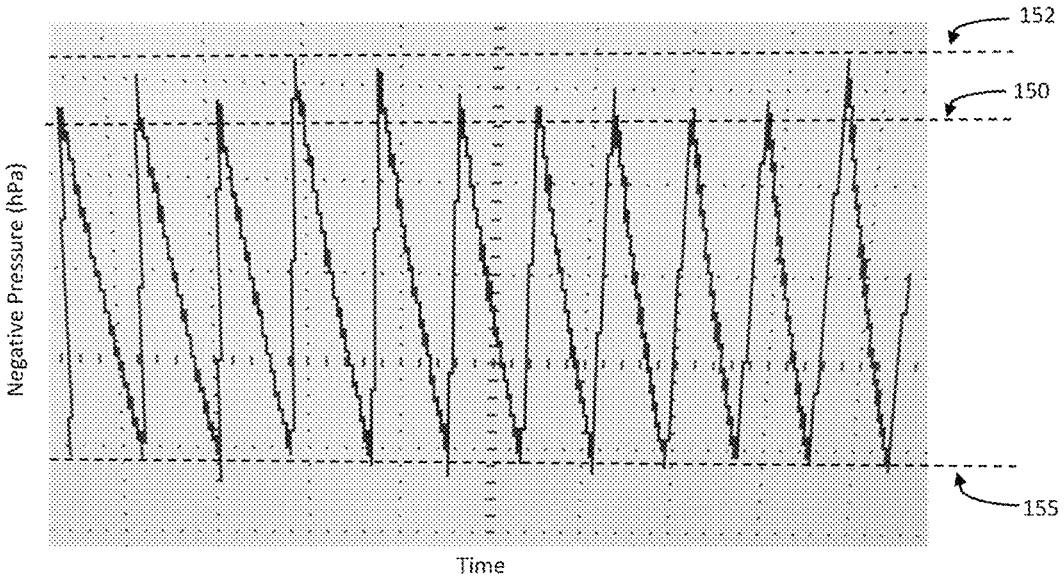
FIG. 9 is a image of an oscilloscope display showing the output of an embodiment of the invention showing the variation in negative pressure over time using a discontinuous pump wherein the negative pressure increases to an upper negative pressure threshold 150 as voltage is applied and decreases to a lower negative pressure threshold 155 when voltage is decreased. Also shown is a maximum negative pressure threshold 152.

In embodiments of the device, the chamber contains one or more ventilation apertures that provide an airflow through the chamber for comfort, cooling etc. Therefore, the control system must operate the air pump to create an airflow opposite to the ventilation to maintain the approximate constant pressure consistent with the target pressure. As such, during operation, a device containing designed airflow, cycles between the upper 150 and lower 155 pressure limits as the driving voltage cycles from 14V to 0V and 0V to 14V. In an embodiment of the device in normal operation, the air pump is on 100 for a few hundred milliseconds and off 110, 115 for several seconds, FIG. 4. These parameters can vary based on the sampling rate of the absolute pressure sensors and the on/off profile of the voltage ramps. An example of air pump operation can be seen FIG. 9 showing an oscilloscope output reading.

An approximate constant pressure is achieved by the control system sampling pressures inside and outside the chamber, determining the absolute pressure within the camber and, if the absolute pressure is below the target pressure (i.e. not enough negative pressure), the control system will apply a voltage to the air pump and, if the absolute pressure within the chamber is above the target pressure (i.e. too much negative pressure), the control system will not apply a voltage to the air pump until such time as a sampling cycle determines that the absolute pressure is to be within or below the approximate target pressure range.

For example, following start up and establishing the therapeutic level of negative pressure, if the target negative pressure in the chamber is approximately 30 hPa with an allowed range of about plus or minus about 2 hPa and a ventilation flow rate of approximately 30 cc/min the air pump must move 30 cc of air per minute in order to maintain an approximate constant pressure. In situations where the absolute pressure within the chamber is below the target pressure, the control system may apply different voltages depending upon how far outside the target pressure the absolute pressure within the chamber is to increase the airflow through the pump, for example applying a voltage higher than operational voltage, resulting in higher airflow, the further away the chamber pressure is from the target pressure. In embodiments of the control system, the voltage applied to the air pump may vary depending upon how far away the absolute pressure the chamber falls from the target pressure.

Figure 8:
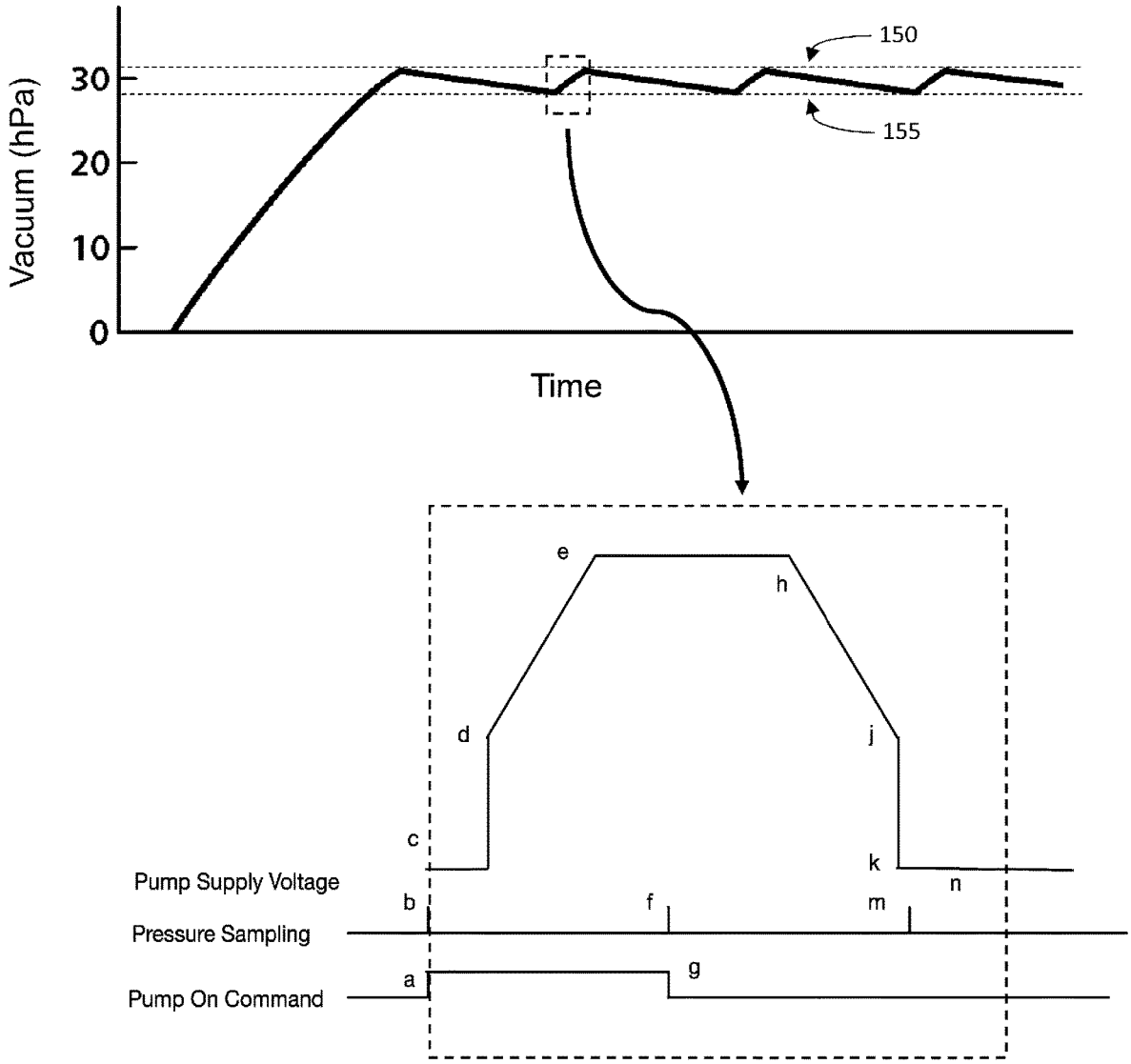
FIG. 8 is a graphical representation of an embodiment of the invention showing upper negative pressure threshold 150 and lower negative pressure threshold 155 (upper drawing) and a representative cycle for one set of operating conditions of the control system containing time points (a-n; lower drawing) illustrating pump on command time (a), pump off command time (g), pressure sampling times (b) (f) and (m) and pump supply voltages at times (c, d, e, h, j, k, and n), wherein when the lower negative pressure threshold 155 is sampled at time point (b), a pump on command is sent (a) and a voltage ramp is applied and a therapy voltage is maintained until the upper negative pressure threshold 150 is sampled (f) and pump on command is terminated (g) and airflow through the chamber causes a gradual decrease in negative pressure. When a lower negative pressure threshold 155 is sampled a pump on command will initiate and cycle will repeat.

In an additional example, FIG. 8 shows the upper negative pressure threshold 150 and lower negative pressure threshold 155 and a representative cycle for one set of operating conditions of the control system containing time points wherein, the pump is turned on (a), operational pressure is reached (e), a pressure above the target pressure is observed (f) and the pump off signal is sent (g) and pump supply voltage returns to zero (k). The diagram shows an approximate 88-90 millisecond cycle from time point "a" to "n". Pressure achieves maximum flow after about 28 milliseconds (time point e) in response to pressure sensors sampling every about 40 milliseconds (b, f, and m). The cycle starts with the pump "on" command at time point "a/b" when pressure is simultaneously sampled. The pump voltage ramp process responds within about 10-80 microseconds time point "c". The voltage ramp process begins with supply voltage at about 5 volts, time point "d" and ramps to about 14 volts from time points "d" to "e", approximately about 18 milliseconds. From time points "e" to "h" the pump is at a set flow rate at the treatment flow voltage. At time point "f/g" the pressure sensors detect a pressure above the target pressure range and the control system operates to turn the pump "off". Pump may continue about an additional 20 milliseconds to time point "h" due to sampling and frequency adjusting of the pump and begins a ramp downward time point "h" to "j". At time point j to pump and the power supply to the pump will switch "off" for about an additional 2 milliseconds as pump oscillations or other operations decay. At time point "m" the pressure sample will record a loss of pressure due to the vent airflow however the pump will not cycle back on until the pressure of the chamber is within or below the target pressure range. When a lower negative pressure threshold 155 is sampled a pump on command will initiate and cycle will repeat.

In an additional example of the control system, FIG. 9 shows an oscilloscope display showing the variation in negative pressure over time using a discontinuous pump, wherein as voltage is appied to the air pump 18, the negative pressure increases to an appproximate upper negative pressure threshold 150, when the upper negative pressure threshold 150 is detected, voltage is removed from the pump 110 and pressure gradually decreases until the lower negative pressure threshold 155 is deteteced. When the lower negative pressure threshold 155 is deteteced, voltage is reapplied to the air pump 18 until the upper negative pressure threshold 150 is detected continuing the disgontinuous pump cycle. In certain instances of the invention, in addition to the upper negative pressure threshold 150 a maximum negative pressure threshold 152 may be set such that if one or both are exceeded for predetermined period of time, i.e, time out period (FIG. 4, 145) the control system can be designed to remove voltage from the air pump 18 until such time as proper operational paramters can be maintained.

It is undesirable for an air pump to turn on and remain in an energized state to create excessive negative pressure, therefore in certain aspects of the device upper limits of negative pressure are set, upper negative pressure limit 150 and maximum upper nevative pressure limit 152, that when exceeded beyond a predetermined period of time the pressure control system will disconnect voltage from the air pump, disabling the air pump. Further it is undesirable for the air pump to remain in an energized state when no negative pressure can be established, therefore in certain aspects of the device, upper limits of boost voltage time may be set such that when exceeded beyond a predetermined period of time period (time out period, FIG. 4, 145) the pressure control system will disconnect voltage 110 from the air pump disabling the air pump. In embodiments of the invention, if the boost voltage 180 is found to exceed approximately 1 minute the control system will remove voltage from the air pump FIG. 3. 145, 110.

In certain embodiments of the device, air pumps that have the ability to rapidly respond to creating flow based on changes in pressure data within the device may require a redundant backup system to act as a safety circuit that can act independently of the first pressure control system. Therefore, in certain aspects of the device, more than one processing element is present, each processing element connected to a unique set of internal and external absolute output barometers and sensors. The first processing element 11, acting as the pressure control system element, acts to monitor and control the pressure within the device by applying or removing a voltage ramp to the pump and a second processing element 12, that provides for an independent monitoring and safety circuit that acts to provide data independent the first pressure control system and an independent means of removing voltage to (i.e. a swiching mechanism FIG. 2 and FIG. 3, 17) and disabling the pump if specific pressure and time profiles outside controls limits are observed.

Therefore, the control system of the instant invention may contain a first processing element 11 containing at least a first 13 and second 14 digital output barometric sensor located and monitoring absolute pressure internal 22 and external 21 the chamber. The processing elemenet 11 of the first control system serving to control solely the pump wherein the first pump control system creates a supply of high voltage to energize the air pump electronics wherein the processing element contains non-volatile memory with profiles for regulating the flow rate of the air pump in order to maintain the therapeutic level of negative pressure within the chamber element. The control system of the instant invention may also contain a second processing element 12 containing at least a third 15 digital output absolute barometric sensor, located and monitoring absolute pressure inside the chamber element 22 and preferably a fourth 16 digital output barometric sensor external 21 the chamber, although the second processing element 12 could utilize the second 14 digital output absolute barometric sensor from the first processing element 11 for pressure outside the chamber. In insances of the invention in order to maintain two truly independent control systems, a fourth 16 digital output absolute barometric sensor is preferred located and monitoring absolute pressure outside the chamber. The third 15 and fourth 16 digital output absolute barometric sensors serving to solely monitor the absolute pressure within the chamber for the second processing element 12 and to act as safety system such that when a discrepancy between the absolute pressure values between the first processing element 11 and second processing element 12 occur the second processing element 12 can be configured to switch power off to the air pump 18.

In further embodiments of the invention the digital output absolute barometric sensors may contain integrated temperature compensating sensors. In the same manner where the first processing element 11 acts to monitor, adjust and control the air pump element 18 based on data received operably connected sensors and the second processing element 12 can serve as a redundant monitoring and safety circuit, where in the operably connected digital output absolute barometric sensors, when integrated with temperature compensating sensors, can also be employed to shut the device down when a discrepancy in temperatures from the first processing element 11 and second processing element 12 is observed or at any set temperature that may be deemed as a safety risk and or source of discomfort to the patient. The system(s) can be programed to restart when an acceptable temperature range is re-established or remain inoperable until a service is completed.

In certain embodiments the first processing element may contain flow rate profiles within its nonvolatile memory that only allow for a differential negative pressure of about 40 hPa (upper pressure limit 150) for a maximum of about 5 seconds before signaling to remove the applied maximum voltage and a second processing element may contain a flow rate profile within its nonvolatile memory that only allows for a differential negative pressure of about 45 hPa (maximum upper pressure limit FIG. 9, 152) for a maximum of about 5 seconds before switching power off to the air pump 18. These examples are not meant to be limiting as one skilled in the art would recognize that faster air pumps may require higher sampling rates and slower air pumps lower sampling rates. Further, a lower volume chamber would require a slower pump and or a higher sampling rate to accommodate and anticipate rapid chamber evacuation and avoid exceeding desired pressure ranges.

In particular, the therapy device referred to herein relates but is not limited to an external therapy appliance for relieving upper airway obstruction. U.S. patent application Ser. Nos. 12/002,515, 12/993,311 and 13/881,836 which are hereby incorporated by reference in their entirety including all tables, figures and claims, describes a therapy appliance for relieving airway obstruction. Increasing the patency of the upper airway of an individual alleviates conditions such a snoring, sleep apnea, full or partial upper airway collapse. As described therein, a device is configured to fit under the chin of a user at an external location corresponding to the soft tissues overlying the upper respiratory passages of the neck.

For purposes of the patent application, the term "about" refers to +/−10% of any given value.

The pressure control system of the instant invention can be used in a negative pressure therapy that contains but is not limited to a chamber element with a sealable aperture to accommodate an air pump source and apertures to create airflow through the chamber element and a sealing surface in the approximate shape of the contact surface of the target therapy area. In some embodiments the sealing surface may be in the form of a cushion element and may contain additional adhesion promoters to releasably adhere to the user and promote sealing of the device to the user The chamber element may be in the form of a flexible dome or in the form of a flexible membrane mechanically supported by an internal skeletal structure designed to apply equal contact pressure throughout all points of contact between the user and a sealing surface. U.S. Provisional Patent Application No. 62/281,063 filed: Jan. 20, 2016, titled: "Device and Method for Opening an Airway," and incorporated herein by reference, discusses a flexible dome containing variations in flange and chamber characteristics for the balancing of contact pressure. Further, U.S. Provisional Patent Application No. 62/305,494 filed Mar. 8, 2016, titled "Device and Method for Opening an Airway" and incorporated herein by reference, discusses a flexible membrane mechanically supported in the form of a dome with apertures for airflow and an air pump to provide negative pressure and a sealing surface for the application of negative pressure at a therapy site and the balancing of contact pressure.

In certain embodiments the sealing element may be a cushion element containing a series of layers, including an air layer and a foam layer housed in a fluidly sealed chamber, to provide for a cushioning surface. The inner surface of the flange being that which makes contact with the flexible membrane element and the outer surface of the cushion element being that which makes contact with the skin of the user. U.S. Provisional Patent Application No. 62/260,211 filed, Nov. 25, 2015 titled: "Chamber Cushion, Seal and Use Thereof", incorporated herein by reference discusses such a cushioned sealing element.

The cushion element of the sealing surface is adapted to have sectional properties that allow for flexibility and uniform regional compliance. As used herein, "uniform regional compliance" refers to a property of the cushion element that permits the cushion element to "mold" itself to a surface and or surface variation on the contact surface with the wearer. As described hereinafter, this uniform regional compliance is provided, in part, by the sectional properties or features associated with a region on the cushion element.

The cushion element comprises a fluidly sealed chamber; and a foam layer and/or a semi-rigid ribbon layer housed within the fluidly sealed chamber. The term "fluidly sealed" refers to a chamber that retains the fluid contained within the chamber for a period of time required for normal use of the chamber. By way of example, a latex balloon is "fluidly sealed" to helium if normal use of the balloon is for 6 hours, despite the fact that over time that helium may ultimately leak from the balloon, and despite the fact that the balloon may burst if put under abnormal conditions.

Optionally, an adhesive layer is located on the surface of the sealing element that makes contact with the user. This aims to reduce movement of the device on the wearer as well as enhance the seal and cushioning on the wearer. These elements are configured to maintain an approximate uniform contact pressure with minimized pressure variations along the skin of an individual through all points of contact of the therapy device on a patient. By "minimized pressure variation" means a pressure at any point between the contact surface of the sealing element and the patient's tissue varies by no more than about 20%, and preferably no more than about 10% or about 5%, from the average pressure across the entire contact surface. The outer contact surface, as used herein, is the surface of the sealing element of the therapy device that makes contact with the skin of the individual forming the contact and sealing surface of the therapy device.

In certain embodiments, the sealing element of the invention provides a contact interface of a negative pressure therapy device configured to conform to a continuous contact area on the individual at the external area of the neck approximately corresponding to the anterior triangle of the neck. The term "approximately corresponding to" an anatomical location refers to contacting closely to the actual location, shape or size but perhaps not necessarily completely, accurately or exactly.

Most preferably, the sealing element is configured to follow the contour of the therapy device which is designed to approximately conform to an individual from approximately a first location corresponding to a first gonion on one side of the individuals mandibular body to a second location corresponding to the individuals mental protuberance to a third location corresponding to the second gonion on the opposite side of the individual's mandibular body and a fourth location corresponding to the individuals thyroid cartilage further configured to return to approximately the first location corresponding to the first gonion The gonion, as used herein, describes the approximate location on each side of the lower jaw on an individual at the mandibular angle. The mandibular protuberance, as used herein, describes the approximate location of the chin, the center of which may be depressed but raised on either side forming the mental tubercles. The thyroid cartilage, as used herein, describes the approximate location of the large cartilage of the larynx in humans.

As discussed herein, the sealing element of the instant invention forms the interface between the chamber element of the therapy device and the contact surface of the individual. The flexible membrane chamber element of the instant invention forms the dome/chamber of the therapy device. These elements comprise structural features that provide minimized pressure variation at stations where contact pressure variation can occur as a result of either anatomical variation, tissue variation, inherent therapy device design, and or movement during usage. The sealing element and flexible membrane chamber element thereby providing features to the therapy device to minimize peak contact pressure values, minimize the variance from station to station, and equalize the contact pressure of the therapy device when a therapeutic level of negative pressure is applied to provide an effective seal.

The term "seal" as used in this context is not to necessarily imply that a perfect seal is formed between the therapy device and the contact surface of the individual. Rather, a "seal" is a portion of the device which mates to the wearer and maintains a therapeutic level of vacuum. A certain amount of leakage at the seal may be tolerated so long as the desired negative pressure can be achieved and maintained. Preferred operational vacuum levels are in a range of between about 7.6 hPa to about 61 hPa. Preferred forces applied to the user's neck tissues in order to assist in opening the upper airway passages are in a range of about 0.5 kilogram to about 6.68 kilograms. The term "about" and "approximately" as used herein with regard to any value refers to +/−10% of that value.

The dome of the negative pressuer therapy device, enclosed by the chamber provides a finite volume which must be evacuated to deliver the desired partial vacuum level. Once generated, the partial vacuum will decay at a rate which is primarily controlled by leakage of air into the chamber past the seal and or features integrated into the dome to provide airflow. In certain embodiments, the chamber encloses a volume of between about 8 cc and 200 cc. Preferably, the leakage is no more than between about 0.008 cc/min and about 8 cc/min, and most preferably between about 0.1 cc/min and about 1.6 cc/min.

The therapy device may comprise one or more vent elements. As used herein a vent element is an aperture through the therapy device that provides airflow in to the chamber when the chamber is mated to the individual and a therapeutic level of negative pressure is applied within the chamber. The aperture(s) can be in any suitable location on the device however in some embodiments the aperture(s) may be located at the top of the chamber, where they are less susceptible to occlusion resulting from debris and or tissue ingress into the chamber and closer to locations one and three on the individual where they induce airflow more globally throughout the interior of the chamber. The vent element(s) may simply be an aperture such that when the chamber is mated to the individual and a therapeutic level of negative pressure is applied, an airflow between about 30 mL/min and about 100 mL/min is achieved or an aperture through which a filter element can be inserted to create filtered airflow such that when the chamber is mated to the individual and a therapeutic level of negative pressure is applied an airflow between about 30 mL/min and about 100 mL/min is achieved. The filter element can be a replaceable element and comprise a pore size of between about 0.25 μm and about 1.0 μm or less such that when the chamber is mated to the individual and a therapeutic level of negative pressure is applied, an airflow between about 30 mL/min and about 100 mL/min is achieved. In certain embodiments the airflow is between about 30 mL/min and about 50 mL/min.

The present invention provides both sufficient regional, and overall, compliance of the therapy device such that local bottoming/regional collapse of the device does not occur under load. As used herein, "regional compliance" of the device refers to the ability of individual stations of the device to accommodate a therapeutic level of vacuum without complete compression at that station. As used herein, "overall compliance" of the device refers to the ability of the device to accommodate a therapeutic level of vacuum without complete compression of the device. Further, bottoming or "regional collapse", as used herein, is defined as a complete or near complete compression of the device that its resistance to further compression is no longer possible. This results in a hardening of supporting structure(s) by the flexible portions of the device under a heavy load, and loss of comfort by the wearer.

The sealing element and chamber element are designed to create uniform contact pressure onto the skin of the user when a therapeutic level of negative pressure is applied. The sealing element is preferably a perpendicular width (wide and narrow) and thickness to achieve the desired contact pressure properties. The perpendicular width component is the total width of the sealing, from the tip of the outside edge of the sealing element through the root and to the tip of the inside edge of the sealing element. The width of sealing element may vary along the peripheral axis of the contact area of the sealing element to accommodate for station load variations due to non-uniform shape of the therapy device that contains a chamber that is oval in shape and further contains a central bend to accommodate the mating surface on the neck of the patient corresponding to approximately the upper airway and maintain a constant contact pressure of the negative pressure therapy device.

The term "contact pressure" as used herein refers to a pressure imparted on the surface of the skin by the contact surface of the device. Its value can depend on the vacuum present as well as the structural characteristics of the flange such as the perpendicular width and surface area of the contact surface, and can vary at different locations on the flange.

The term "balance" as used herein refers to the contact pressure of the therapy device being approximately equal across the entire contact surface. This contact pressure is proportional to therapy vacuum levels relative to the contact area of the therapy device. For example, in a comparison, a larger contact area vis. a smaller contact area, under the same therapy vacuum level will provide for lower contact pressure of the therapy device respectively. In an embodiment of the invention, the contact area of the flange relative to the therapy area provides for a contact pressure that may range from approximately 0.9 to approximately 1.5 times the vacuum level and in a preferred embodiment the contact pressure of the flange element is approximately 1.2 times greater than therapy vacuum levels.

The chamber is operably connected to an air pump to produce the therapeutic level of negative pressure within the chamber element. The air pump can be of any type suitable to produce the therapeutic level of negative pressure, for example positive displacement pumps, impulse pumps, velocity pumps, etc which can include manual squeeze bulbs, rotary pumps, lobe pumps, oscillatory pumps etc. In certain embodiments the air pump comprises a piezoelectric material configured to provide an oscillatory pumping action wherein the oscillatory pumping motion operates at a frequency greater that 500 Hz.

The air pump may be a separate component connected to the chamber via a hose or tube, or may be configured integrally to the chamber. The air pump can be connected to the chamber element in any suitable fashion, for example an air pump may be externally located outside of the chamber element and connected via a hose or tube, eg. a stationary bed-side pump, or the pump may be integral to chamber, be battery powered, and wearable by the patient. In certain wearable aspects, the air pump is configured to be integral to the chamber. For example, the air pump may be configured to insert into a sealable aperture on the chamber, the air pump tightly fitting through the aperture creating a seal. As used herein a sealable aperture is an opening through an element of the apparatus that can be closed or sealed from one side or the other with another element of the apparatus creating an air-tight or water tight seal.

As used herein, "user compliance" refers to the patient's adherence to the prescribed usage of a therapy device for example the usage of a device throughout a sleep cycle. As used herein, "device compliance" refers to the ability of the device or elements of the device to accommodate variation, for example, bending, twisting, compressing and or expanding of the device in response to device application and usage including anatomical variations of the patient.

Aspects of the device may be made of a generally rigid material. The term "generally rigid" as used herein refers to a material which is sufficiently rigid to maintain the integrity of the particular element in question. The skilled artisan will understand that a number of polymers may be used including thermoplastics, some thermosets, and elastomers. Thermoplastic materials become flowing liquids when heated and solids when cooled, they are often capable of undergoing multiple heating/cooling cycles without losing mechanical properties. Thermoset materials are made of prepolymers which upon reaction cure irreversibly into a solid polymer network. Elastomers are viscoelastic materials which exhibit both elastic and viscous properties and can be either a thermoplastic or thermoset. Common thermoplastics include PMMA, cyclic olefin copolymer, ethylene vinyl acetate, polyacrylate, polyaryletherketone, polybutadiene, polycarbonate, polyester, polyetherimide, polysulfone, nylon, polyethylene, and polystyrene. Common thermosets include polyesters, polyurethanes, duroplast, epoxy resins, and polyimides. This list is not meant to be limiting. Functional filler materials such as talc and carbon fibers can be included for purposes of improving stiffness, working temperatures, and part shrinkage.

Aspects of the device may be formed using a number of methods known to those of skill in the art, including but not limited to injection molding, machining, etching, 3D printing, etc. In preferred embodiments, the test device base is injection molded, a process for forming thermoplastic and thermoset materials into molded products of intricate shapes, at high production rates and with good dimensional accuracy. The process typically involves the injection, under high pressure, of a metered quantity of heated and plasticized material into a relatively cool mold—in which the plastic material solidifies. Resin pellets are fed through a heated screw and barrel under high pressure. The liquefied material moves through a runner system and into the mold. The cavity of the mold determines the external shape of the product while the core shapes the interior. When the material enters the chilled cavities, it starts to re-plasticize and return to a solid state and the configuration of the finished part. The machine then ejects the finished parts or products.

The following are exemplary embodiments of the invention:

Embodiment 1

A pressure control system for controlling the application of negative pressure to an external surface of an individual, comprising:

a chamber element configured to define a chamber overlying the external surface of the individual and to apply a force to the external surface of the individual when a therapeutic level of negative pressure is applied within the chamber element;

a control module comprising (i) one or more circuit boards having a first surface exposed to the negative pressure within the chamber element and a second surface exposed to atmospheric pressure external to the chamber element, (ii) a first absolute output barometer positioned on the first surface and configured to produce a first time-dependent waveform indicative of an absolute pressure within the chamber element, (iii) a second absolute output barometer positioned on the second surface and configured to produce a second time-dependent waveform indicative of an absolute atmospheric pressure external to the chamber element, (iv) a first processing element operably connected to the first absolute output barometer and the second absolute output barometer and configured to receive the first and second time-dependent waveform and to calculate therefrom a time-dependent value for the negative pressure within the chamber element which is relative to the absolute atmospheric pressure external to the chamber element, and (v) a first memory element which stores a predetermined range for the therapeutic level of negative pressure to be applied within the chamber element; and an air pump operably connected to the chamber to produce the therapeutic level of negative pressure within the chamber element, wherein the air pump is operably connected to the control module, and wherein the flow rate of the air pump is regulated by the control module to maintain the therapeutic level of negative pressure within the chamber element within the predetermined range based upon the time-dependent value for the negative pressure within the chamber element.

Embodiment 2

A pressure control system according to Embodiment 1, wherein the predetermined range comprises a maximum value, a minimum value, and a midpoint value, and the maximum and minimum values are each within about plus or minus 2 hPa of the midpoint value.

Embodiment 3

A pressure control system according to Embodiment 2, wherein the midpoint value is between about 10 hPa and about 60 hPa.

Embodiment 4

A pressure control system according to Embodiment 2, wherein the midpoint value is between about 25 hPa and about 35 hPa.

Embodiment 5

A pressure control system according to Embodiment 3, wherein the midpoint value is about 30 hPa.

Embodiment 6

A pressure control system according to one of Embodiments 2-6, wherein the first non-volatile memory further stores a first profile for regulating of the flow rate of the air pump in order to maintain the therapeutic level of negative pressure within the chamber element within the predetermined range, wherein the first profile is configured to energize the air pump when the minimum value is reached and to turn off the air pump when the maximum value is reached.

Embodiment 7

A pressure control system according to Embodiment 6, wherein the first profile is configured to energize the air pump when the minimum value is reached by applying a voltage ramp to the air pump which increases the flow rate of the air pump proportionally to the voltage ramp.

Embodiment 8

A pressure control system according to Embodiment 7, wherein the voltage ramp is linear.

Embodiment 9

A pressure control system according to Embodiment 7, where in the voltage ramp is not linear.

Embodiment 10

A pressure control system according to one of Embodiments 1-9, wherein the chamber element comprises one or more air vents configured to provide a predetermined level of airflow into the chamber element.

Embodiment 11

A pressure control system according to one of Embodiments 2-10, wherein the first non-volatile memory further stores a second profile for regulating of the flow rate of the air pump in order to reach the therapeutic level of negative pressure within the chamber element when the time-dependent value for the negative pressure within the chamber element is equal to the absolute atmospheric pressure external to the chamber element, wherein the second profile is configured to initially energize the air pump to produce a maximum flow rate and to slow the flow rate as the time-dependent value for the negative pressure within the chamber element approaches the therapeutic level of negative pressure.

Embodiment 12

A pressure control system according to one of Embodiments 1-11, wherein the first processing element and the first memory element are located on the circuit board.

Embodiment 13

A pressure control system according to one of Embodiments 1-11, further comprising:

(vi) a third absolute output barometer configured to produce a third time-dependent waveform indicative of an absolute pressure within the chamber element, (vii) a fourth absolute output barometer configured to produce a fourth time-dependent waveform indicative of an absolute atmospheric pressure external to the chamber element, (viii) a second processing element operably connected to the third absolute output barometer and the fourth absolute output barometer and configured to receive the third and fourth time-dependent waveform and to calculate therefrom a second time-dependent value for the negative pressure within the chamber element which is relative to the absolute atmospheric pressure external to the chamber element, and (ix) a second memory element which stores a safety limit value for the therapeutic level of negative pressure to be applied within the chamber element, wherein the second processing element is operably connected to the air pump, and wherein the second processing element is configured to turn off the air pump when the safety limit value is reached.

Embodiment 14

A pressure control system according to Embodiment 13, wherein the third absolute output barometer is positioned on the first surface and the fourth absolute output barometer is positioned on the second surface.

Embodiment 15

A pressure control system according to Embodiment 13, wherein the second processing element and the second memory element are located on the circuit board.

Embodiment 16

A pressure control system according to one of Embodiments 1-15, wherein the first and second absolute output barometers each comprise a temperature sensor, and the first and second time-dependent waveforms are compensated for temperature measured by the corresponding temperature sensor.

Embodiment 17

A pressure control system according to one of Embodiments 1-16, wherein the third and fourth absolute output barometers each comprise a temperature sensor, and the third and fourth time-dependent waveforms are compensated for temperature measured by the corresponding temperature sensor.

Embodiment 18

A pressure control system according to one of Embodiments 1-17, wherein the first and second absolute output barometers are digital output barometers.

Embodiment 19

A pressure control system according to one of Embodiments 1-18, wherein the first and second absolute output barometers operate at a sampling rate of at least about 10 Hz.

Embodiment 20

A pressure control system according to one of Embodiments 1-19, wherein the first and second absolute output barometers operate at a sampling rate of at least about 25 Hz, at least about 50 Hz, at least about 70 Hz, or at least about 200 Hz.

Embodiment 21

A pressure control system according to one of Embodiments 1-20, wherein the chamber element is configured to enclose an external area of the anterior portion of the neck overlying a portion of the upper respiratory passage.

Embodiment 22

A pressure control system according to one of Embodiments 1-21, futher comprising one or more accelerometers configured to provide a signal indicating the orientation of the individual, and wherein the control system is configured to process the signal to determine the orientation of the individual and alter the therapeutic level of negative pressure within the chamber based on changes in the orientation of the individual.

Embodiment 23

A pressure control system according to Embodiment 22, wherein the therapeutic level of negative pressure within the chamber differs for a supine orientation versus a prone or a lateral recumbent orientation.

Embodiment 24

A pressure control system according to Embodiment 23, wherein the therapeutic level of negative pressure within the chamber is higher in a sustained supine orientation as compared to a sustained lateral recumbent orientation, wherein a sustained position refers to a position that is maintained for at least 0.5 seconds, preferably for at least 10 seconds, more preferably at leaset 30 seconds, and most preferably for at least 60 seconds.

Embodiment 25

A pressure control system according to one of Embodiments 22-24, wherein the control system is further configured to alter the therapeutic level of negative pressure within the chamber based on a level of movement of the individual that exceeds a threshold value.

Embodiment 26

A method of applying negative pressure to a location of an individual, comprising:

providing a pressure control system according to one of Embodiments 1-25;

placing the chamber element on a portion of a subject to form the chamber having an interior volume formed between the subject's body and the evacuation enclosure; and energizing the air pump to remove air from the interior volume within the chamber.

Embodiment 27

A method for managing a change in air flow from a piezoelectric-based air pump, comprising:

increasing airflow by applying an increasing drive voltage to the piezoelectric-based air pump as a continuous ramp function from a first voltage to a second voltage, wherein the flow rate of the air pump increases proportionally to the amount of drive voltage being applied, and wherein the continuous ramp function reduces an audible sound emitted by the piezoelectric-based air pump by at least 50% relative to applying drive voltage as a step function from the first voltage to the second voltage, and/or decreasing airflow by applying a decreasing drive voltage to the piezoelectric-based air pump as a continuous ramp function from a third voltage to a fourth voltage, wherein the flow rate of the air pump decreases proportionally to the amount of drive voltage being applied, and wherein the continuous ramp function reduces an audible sound emitted by the piezoelectric-based air pump by at least 50% relative to applying drive voltage as a step function from the third voltage to the fourth voltage.

Embodiment 28

A method according to Embodiment 27, wherein the audible sound is a click.

Embodiment 29

A method according to Embodiment 27 or 28, wherein the piezoelectric-based air pump is a component of a device comprising a chamber element configured to define a chamber overlying the external surface of the individual and to apply a force to the external surface of the individual when a therapeutic level of negative pressure is applied within the chamber element when the piezoelectric-based air pump is energized.

Embodiment 30

A method according to Embodiment 29, wherein the device is used by an individual during sleep.

Embodiment 31

A method according to one of Embodiments 27-30, wherein the voltage ramp function is a linear function in which the drive voltage changes at a rate of between about 4000 v/sec and about 500 v/sec.

Embodiment 32

A method according to Embodiment 25, wherein the voltage changes at a rate of about 2000 v/sec+/−500 v/sec.

Embodiment 33

A method according to one of Embodiments 27-32, wherein the voltage ramp function is a nonlinear function in which the drive voltage changes at a rate of between about 4000 v/sec and about 500 v/sec.

Those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Structural embodiments of the apparatus may vary based on the size of the device and the description provided herein is a guide to the functional aspects and means. One skilled in the art readily appreciates that the present invention is well adapted to carry out the objects and obtain the ends and advantages mentioned, as well as those inherent therein. The examples provided herein are representative of preferred embodiments, are exemplary, and are not intended as limitations on the scope of the invention.

It will be readily apparent to a person skilled in the art that varying substitutions and modifications may be made to the invention disclosed herein without departing from the scope and spirit of the invention.

All patents and publications mentioned in the specification are indicative of the levels of those of ordinary skill in the art to which the invention pertains. All patents and publications are herein incorporated by reference to the same extent as if each individual publication was specifically and individually indicated to be incorporated by reference.

The invention illustratively described herein suitably may be practiced in the absence of any element or elements, limitation or limitations which is not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

Other embodiments are set forth within the following claims:

What is claimed is:

1. A pressure control system for controlling application of negative pressure to an external surface of an individual, comprising:

a chamber element configured to define a chamber overlying the external surface of the individual and to apply a force to the external surface of the individual when a therapeutic level of negative pressure is applied within the chamber element;

a control module comprising (i) one or more circuit boards having a first surface exposed to the negative pressure within the chamber element and a second surface exposed to atmospheric pressure external to the chamber element, (ii) a first absolute output barometer positioned on the first surface and configured to produce a first time-dependent waveform indicative of an absolute pressure within the chamber element, (iii) a second absolute output barometer positioned on the second surface and configured to produce a second time-dependent waveform indicative of an atmospheric pressure external to the chamber element, (iv) a first processing element operably connected to the first absolute output barometer and the second absolute output barometer and configured to receive the first and second time-dependent waveforms and to calculate therefrom a time-dependent value for the negative pressure within the chamber element which is relative to the atmospheric pressure external to the chamber element, and (v) a first non-volatile memory element which stores a predetermined range for the therapeutic level of negative pressure to be applied within the chamber element, wherein the first non-volatile memory element further stores a first profile for regulating of a flow rate of an air pump in order to maintain the therapeutic level of negative pressure within the chamber element within the predetermined range, wherein the first profile is configured to energize the air pump when a minimum value is reached and to turn off the air pump when a maximum value is reached, and a second profile for regulating of the flow rate of the air pump in order to reach the therapeutic level of negative pressure within the chamber element when the time-dependent value for the negative pressure within the chamber element is equal to the atmospheric pressure external to the chamber element, wherein the second profile is configured to initially energize the air pump to produce a maximum flow rate and to slow the flow rate as the time-dependent value for the negative pressure within the chamber element approaches the therapeutic level of negative pressure; and the air pump operably connected to the chamber to produce the therapeutic level of negative pressure within the chamber element, wherein the air pump is operably connected to the control module, and wherein the flow rate of the air pump is regulated by the control module to maintain the therapeutic level of negative pressure within the chamber element within the predetermined range based upon the time-dependent value for the negative pressure within the chamber element.

2. A pressure control system according to claim 1, wherein the predetermined range comprises the maximum value, the minimum value, and a midpoint value, and the maximum and minimum values are each within about plus or minus 2 hPa of the midpoint value.

3. A pressure control system according to claim 2, wherein the midpoint value is between about 10 hPa and about 60 hPa.

4. A pressure control system according to claim 2, wherein the midpoint value is between about 25 hPa and about 35 hPa.

5. A pressure control system according to claim 3, wherein the midpoint value is about 30 hPa.

6. A pressure control system according to claim 1, wherein the first profile is configured to energize the air pump when the minimum value is reached by applying a voltage ramp to the air pump which increases the flow rate of the air pump proportionally to the voltage ramp.

7. A pressure control system according to claim 6, wherein the voltage ramp is linear.

8. A pressure control system according to claim 6, where in the voltage ramp is not linear.

9. A pressure control system according to claim 1, wherein the chamber element comprises one or more air vents configured to provide a predetermined level of airflow into the chamber element.

10. A pressure control system according to claim 1, wherein the first processing element and the first non-volatile memory element are located on one of the one or more circuit boards.

11. A pressure control system according to claim 1, further comprising:

(vi) a third absolute output barometer configured to produce a third time-dependent waveform indicative of the absolute pressure within the chamber element (vii) a fourth absolute output barometer configured to produce a fourth time-dependent waveform indicative of the atmospheric pressure, (viii) a second processing element operably connected to the third absolute output barometer and the fourth absolute output barometer and configured to receive the third and fourth time-dependent waveform and to calculate therefrom a second time-dependent value for the negative pressure within the chamber element which is relative to the atmospheric pressure external to the chamber element, and (ix) a second memory element which stores a safety limit value for the therapeutic level of negative pressure to be applied within the chamber element, wherein the second processing element is operably connected to the air pump, and wherein the second processing element is configured to turn off the air pump when the safety limit value is reached.

12. A pressure control system according to claim 11, wherein the third absolute output barometer is positioned on the first surface and the fourth absolute output barometer is positioned on the second surface.

13. A pressure control system according to claim 11, wherein the second processing element and the second memory element are located on one of the one or more circuit boards.

14. A pressure control system according to claim 1, wherein the first and second absolute output barometers each comprise a temperature sensor, and the first and second time-dependent waveforms are compensated for temperature measured by the corresponding temperature sensor.

15. A pressure control system according to claim 11, wherein the third and fourth absolute output barometers each comprise a temperature sensor, and the third and fourth time-dependent waveforms are compensated for temperature measured by the corresponding temperature sensor.

16. A pressure control system according to claim 1, wherein the first and second absolute output barometers are digital output barometers.

17. A pressure control system according to claim 1, wherein the first and second absolute output barometers operate at a sampling rate of at least about 10 Hz.

18. A pressure control system according to claim 1, wherein the first and second absolute output barometers operate at a sampling rate of about 25 Hz, about 50 Hz, about 70 Hz, or about 200 Hz.

19. A pressure control system according to claim 1, wherein the chamber element is configured to enclose an external area of an anterior portion of the neck of the individual overlying a portion of the upper respiratory passage.

20. A pressure control system according to claim 1, further comprising one or more accelerometers configured to provide a signal indicating an orientation of the individual, and wherein the control system is configured to process the signal to determine the orientation of the individual and to alter the therapeutic level of negative pressure within the chamber based on changes in the orientation of the individual.

21. A pressure control system according to claim 20, wherein the therapeutic level of negative pressure within the chamber differs for a supine orientation versus a prone or a lateral recumbent orientation.

22. A pressure control system according to claim 21, wherein the therapeutic level of negative pressure within the chamber is higher in a sustained supine orientation as compared to a sustained lateral recumbent orientation, wherein a sustained position refers to a position that is maintained for at least 0.5 seconds.

23. A pressure control system according to claim 20, wherein the control system is further configured to alter the therapeutic level of negative pressure within the chamber based on a level of movement of the individual that exceeds a threshold value.

24. A method of applying negative pressure to a location of an individual, comprising:

providing a pressure control system according to claim 1;

placing the chamber element on a portion of an individual to form the chamber having an interior volume formed between the individual body and the chamber element; and energizing the air pump to remove air from the interior volume within the chamber.

* * * * *